US009790956B2

(12) United States Patent
Takama et al.

(10) Patent No.: US 9,790,956 B2
(45) Date of Patent: Oct. 17, 2017

(54) TURBOCHARGER BEARING HOUSING

(71) Applicant: TAIHO KOGYO CO., LTD., Toyota-shi (JP)

(72) Inventors: Kenichiro Takama, Toyota (JP); Satoru Kanbara, Toyota (JP); Keijiro Maki, Toyota (JP); Ryuji Naruse, Toyota (JP)

(73) Assignee: TAIHO KOGYO CO., LTD., Toyota-Shi, Aichi (JP)

( * ) Notice: Subject to any disclaimer, the term of this patent is extended or adjusted under 35 U.S.C. 154(b) by 391 days.

(21) Appl. No.: 14/389,042

(22) PCT Filed: Mar. 18, 2013

(86) PCT No.: PCT/JP2013/057653

§ 371 (c)(1),
(2) Date: Sep. 29, 2014

(87) PCT Pub. No.: WO2013/146416

PCT Pub. Date: Oct. 3, 2013

(65) Prior Publication Data

US 2015/0056064 A1 Feb. 26, 2015

(30) Foreign Application Priority Data

Mar. 30, 2012 (JP) ..... 2012-080660

(51) Int. Cl.
*F04D 29/40* (2006.01)
*F04D 29/063* (2006.01)
(Continued)

(52) U.S. Cl.
CPC ..... *F04D 29/403* (2013.01); *F01D 25/125* (2013.01); *F02B 39/005* (2013.01);
(Continued)

(58) Field of Classification Search
CPC ..... F02B 39/005; F02B 39/14; F04D 29/063; F04D 29/403; F04D 29/5846;
(Continued)

(56) References Cited

U.S. PATENT DOCUMENTS

2006/0225419 A1* 10/2006 Prusinski ..... F01D 25/18 60/605.1
2007/0169747 A1* 7/2007 Shimizu ..... F01D 25/12 123/434
2009/0101087 A1* 4/2009 Ueno ..... F01D 25/14 123/41.31
2009/0220335 A1* 9/2009 Matsuo ..... F01D 9/026 415/164
2010/0175377 A1* 7/2010 Hippen ..... F02B 37/10 60/602
2010/0284824 A1* 11/2010 Hippen ..... F01M 11/02 417/44.1
(Continued)

FOREIGN PATENT DOCUMENTS

DE WO 2011057950 A1 * 5/2011 ..... F01D 25/162
JP 7-150961 A 6/1995
(Continued)

OTHER PUBLICATIONS

International Search Report (PCT/ISA/210) dated Apr. 23, 2013, by the Japanese Patent Office as the International Searching Authority for International Application No. PCT/JP2013/057653.

*Primary Examiner* — Woody Lee, Jr.
*Assistant Examiner* — Jesse Prager
(74) *Attorney, Agent, or Firm* — Buchanan Ingersoll Rooney PC

(57) ABSTRACT

There is provided a turbocharger bearing housing having no necessity to use a core and capable of achieving cost reduction. A bearing housing of a turbocharger contains a shaft connecting a turbine and a compressor and turnably supports the shaft. The bearing housing of the turbocharger is divided into a turbine-side housing disposed at a turbine side and a compressor-side housing disposed at a compressor side. The turbine-side housing and the compressor-side housing is subjected to machining to thereby form a cooling water passage for supplying cooling water and a lubricating oil passage for supplying lubricating oil.

5 Claims, 17 Drawing Sheets

(51) Int. Cl.

| | |
|---|---|
| ***F04D 29/58*** | (2006.01) |
| ***F01D 25/12*** | (2006.01) |
| ***F02B 39/14*** | (2006.01) |
| ***F02B 39/00*** | (2006.01) |

(52) U.S. Cl.
CPC ..... *F02B 39/14* (2013.01); *F04D 29/063* (2013.01); *F04D 29/5846* (2013.01); *F05D 2220/40* (2013.01)

(58) Field of Classification Search
CPC ..... F04D 25/045; F04D 29/0462; F04D 29/0563; F04D 29/582; F01D 5/125; F01D 25/16; F01D 25/18; F01D 25/20; F05D 2220/40; F05B 2220/40; F04B 39/0246; F04C 29/02
See application file for complete search history.

(56) References Cited

U.S. PATENT DOCUMENTS

| | | | | |
|---|---|---|---|---|
| 2012/0257966 | A1* | 10/2012 | Boening ..... | F01D 25/162 415/229 |
| 2013/0149126 | A1* | 6/2013 | Herrera Celaya .... | F02B 37/183 415/200 |

FOREIGN PATENT DOCUMENTS

| | | | |
|---|---|---|---|
| JP | 9-310620 | A | 12/1997 |
| JP | 2008-223569 | A | 9/2008 |
| JP | 2009-243299 | A | 10/2009 |
| JP | 2010-261365 | A | 11/2010 |

* cited by examiner

TURBOCHARGER BEARING HOUSING

TECHNICAL FIELD

The present invention relates to a technique of a turbocharger bearing housing provided in an internal combustion engine.

BACKGROUND ART

Conventionally, there has been publicly known a technique of a turbocharger bearing housing provided in an internal combustion engine. Such a technique of a turbocharger bearing housing is disclosed, for example, in Japanese Patent Application Laid-Open No. H9-310620.

The turbocharger bearing housing rotatably supports a shaft connecting a turbine driven by exhaust gas and a compressor for compressing intake air. Further, the bearing housing is formed with a cooling water passage for circulating cooling water and a lubricating oil passage for supplying lubricating oil to the shaft.

Such a bearing housing is manufactured by casting using cast iron. Further, in the case where the bearing housing is manufactured by casting, the cooling water passage and the lubricating oil passage can be formed simultaneously by using a predetermined core.

However, in the case where the cooling water passage and the lubricating oil passage are formed by using the core as described above, there is a necessity to manufacture the core separately. Thus, it has a disadvantage of increasing the cost.

DISCLOSURE OF INVENTION

Technical Problem

The present invention has been devised to solve the disadvantageous point described above, and an object thereof is to provide a turbocharger bearing housing having no necessity to use a core and capable of achieving cost reduction.

Solution to Problem

The technical problem of the present invention is described above, and the solution to problem will be described hereafter.

A turbocharger bearing housing according to the present invention contains a shaft connecting a turbine and a compressor, and turnably supports the shaft. The turbocharger bearing housing is divided into a turbine-side housing disposed at a turbine side and a compressor-side housing disposed at a compressor side. The turbine-side housing and the compressor-side housing are subjected to machining to thereby form a cooling water passage for supplying cooling water and a lubricating oil passage for supplying lubricating oil.

In the turbocharger bearing housing according to the present invention, the lubricating oil passage includes a bearing portion that is a through-hole through which the shaft is inserted and which turnably supports the shaft, a second lubricating oil passage for communicating an upper surface of the bearing housing with the bearing portion, and a first lubricating oil passage for communicating a lower surface of the bearing housing with the bearing portion.

In the turbocharger bearing housing according to the present invention, the second lubricating oil passage is formed so as to communicate each of an end portion of the bearing portion at the compressor side and an end portion of the bearing portion at the turbine side with the lower surface of the bearing housing.

In the turbocharger bearing housing according to the present invention, as the cooling water passage, an arc-shaped cooling water passage of an arc shape centered at the shaft is formed on at least one of a surface, which is in contact with the compressor-side housing, of the turbine-side housing and a surface, which is in contact with the turbine-side housing, of the compressor-side housing.

In the turbocharger bearing housing according to the present invention, the lubricating oil passage is subjected to a process for reducing a surface roughness.

Advantageous Effects of the Invention

The advantageous effects of the invention will be described hereafter.

In the turbocharger bearing housing according to the present invention, since the cooling water passage and the lubricating oil passage formed in the bearing housing are formed by performing machining, there is no necessity to use a core when the bearing housing is manufactured by casting. Thus, it is possible to achieve cost reduction. Further, since there is no necessity to form the cooling water passage and the lubricating oil passage by using a sand core at the casting stage, inspecting whether foundry sand is remaining inside the cooling water passage and inside the lubricating oil passage is not needed. Further, by dividing the bearing housing into two members, it is possible to improve workability of the cooling water passage and the lubricating oil passage.

In the turbocharger bearing housing according to the present invention, it is possible to simplify a shape of the lubricating oil passage, and further to improve workability of the lubricating oil passage. Further, by supplying the lubricating oil to the inside of the bearing housing via the second lubricating oil passage, the lubricating oil sequentially circulates through the second lubricating oil passage, the bearing portion, and the first lubricating oil passage in accordance with gravity. Thus, it is possible to circulate the lubricating oil smoothly.

In the turbocharger bearing housing according to the present invention, lubricating oil can be discharged from both the end portions of the bearing portion toward a lower direction of the bearing housing, and thereby the lubricating oil can be circulated smoothly. Further, the lubricating oil can be surely guided to both the ends of the bearing portion, and thereby the bearing portion can be lubricated and cooled effectively.

In the turbocharger bearing housing according to the present invention, by forming the cooling water passage so as to surround a periphery of the shaft, it is possible to effectively suppress a temperature rise of the bearing housing caused by heat transferred from the turbine side via the shaft or heat generated by the rotation of the shaft.

In the turbocharger bearing housing according to the present invention, flow resistance of the lubricating oil passage can be reduced, and thus machine efficiency of the turbocharger can be improved. Further, since lubricating oil does not easily stay in the lubricating oil passage, occurrence of oil caulking can be reduced.

DESCRIPTION OF EMBODIMENTS

In the following description, in accordance with arrows shown in the figures, a front-back direction, an up-down direction, and a left-right direction are defined individually.

Figure 1:
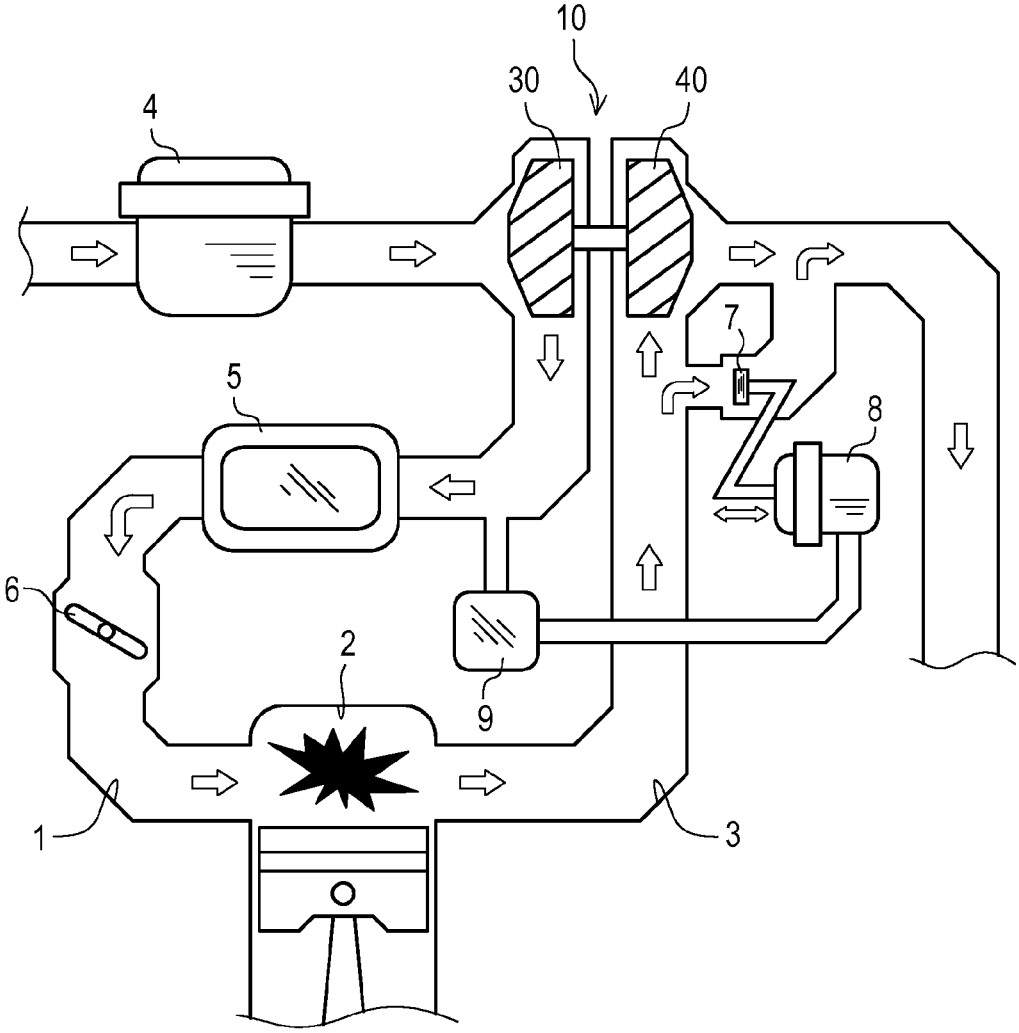
FIG. 1 is a schematic diagram showing an overview of operation for a turbocharger having a bearing housing according to one embodiment of the present invention.
Figure 3:
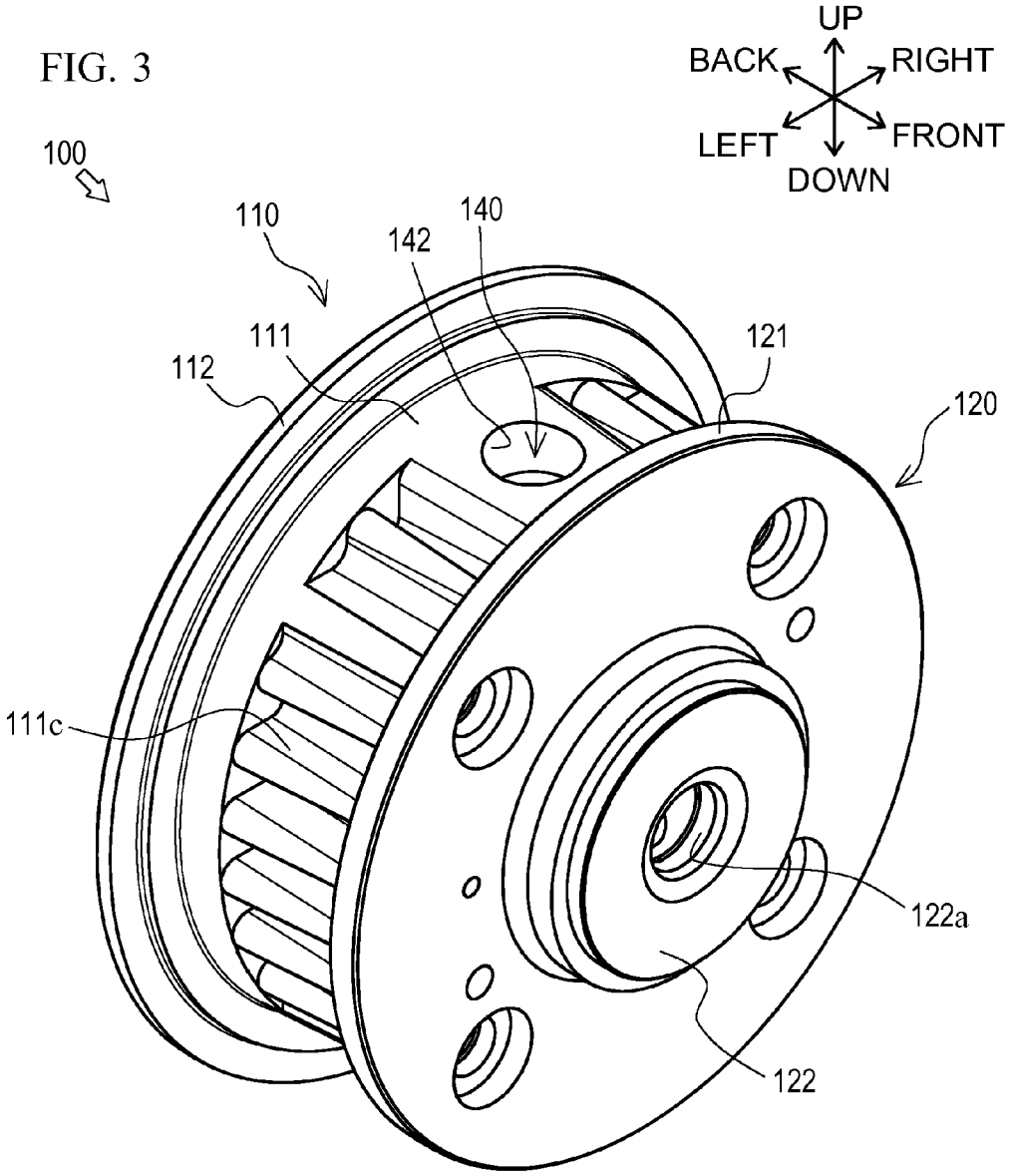
FIG. 3 is a perspective view of the bearing housing according to one embodiment of the present invention.

With reference to FIG. 1, description will be given of an overview of operation for a turbocharger 10 having a bearing housing 100 (refer to FIG. 3 and the like) according to one embodiment of the present invention.

The turbocharger 10 is for feeding compressed air into a cylinder 2 of an engine. The air is supplied to the cylinder 2 via an intake passage 1. The air sequentially passes through an air cleaner 4, the turbocharger 10, an intercooler 5, and a throttle valve 6 which are disposed along the intake passage 1, and then the air is supplied to the cylinder 2. At this time, since a compressor 30 of the turbocharger 10 compresses the air, much more air can be fed into the cylinder 2.

High-temperature air (exhaust) after burning inside the cylinder 2 is discharged via an exhaust passage 3. At this time, the exhaust rotates a turbine 40 of the turbocharger 10, the rotation is transmitted to the compressor 30, and thereby the air inside the intake passage 1 can be compressed.

On the upstream side of the turbine 40, the exhaust passage 3 is branched, and a passage not via the turbine 40 is formed separately. The passage can be opened/closed by a waste gate valve 7. The waste gate valve 7 is driven to open/close by an actuator 8. Further, operation of the actuator 8 is controlled by a negative pressure generating mechanism 9 which is configured by a solenoid valve and the like. The waste gate valve 7 is opened/closed by the actuator 8 so that flow rates of exhaust to be fed to the turbine 40 can be adjusted.

Figure 2:
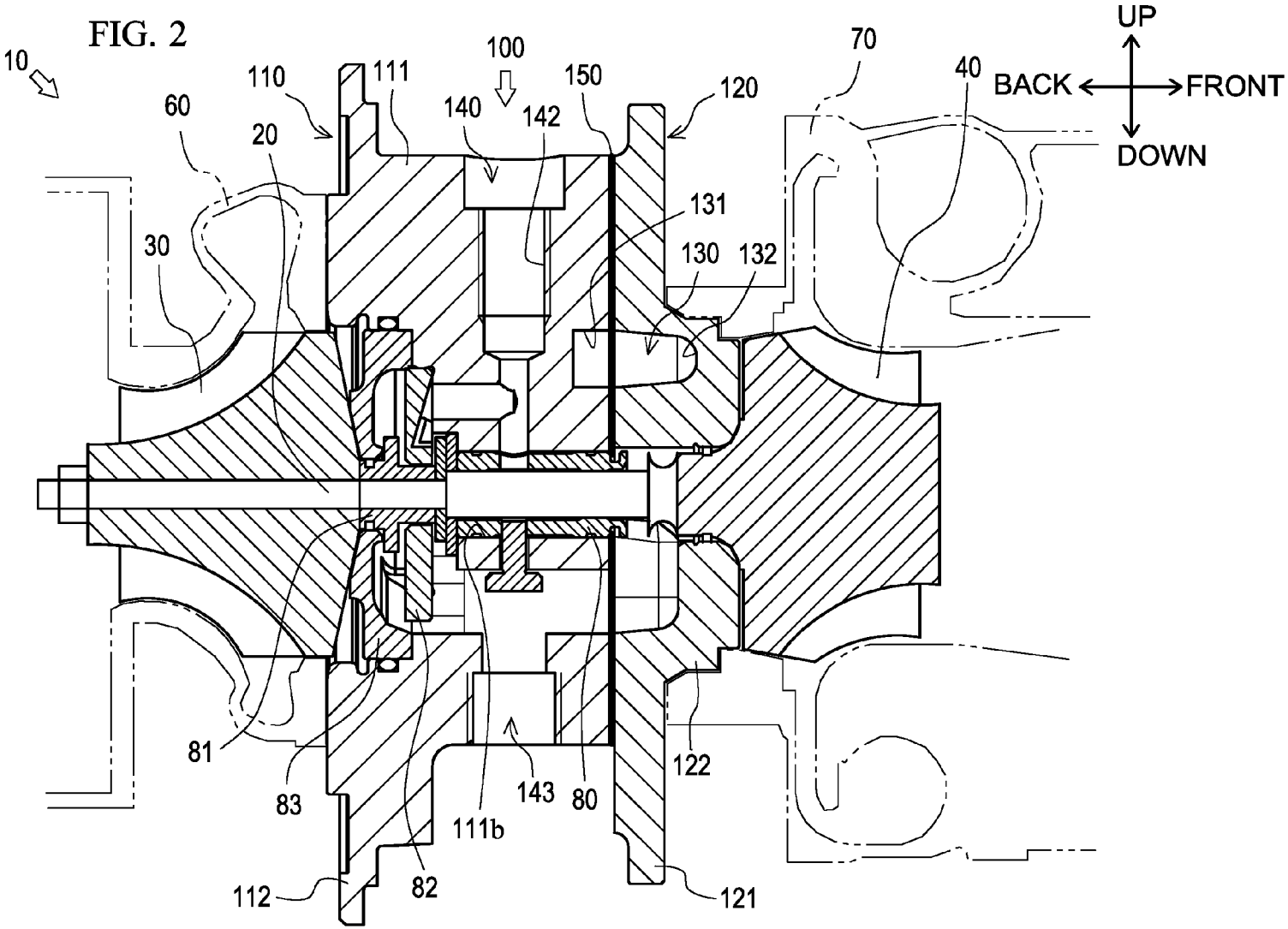
FIG. 2 is a sectional side view showing a configuration of the turbocharger having the bearing housing according to one embodiment of the present invention.

Next, with reference to FIG. 2, description will be given of an overview of a configuration of the turbocharger 10.

The turbocharger 10 mainly includes a shaft 20, the compressor 30, the turbine 40, the bearing housing 100, a compressor housing 60, a turbine housing 70, a sliding bearing 80, a color turbo seal 81, a thrust bearing 82, and a retainer seal 83.

The shaft 20 is disposed such that the longitudinal direction thereof is directed toward the front-back direction. The compressor 30 is fixed to one end (back end) of the shaft 20, and the turbine 40 is fixed to the other end (front end) of the shaft 20. Thus, the shaft 20 connects the compressor 30 and the turbine 40. The shaft 20 is formed of a steel material.

The bearing housing 100 contains the shaft 20, and turnably supports the shaft 20. The shaft 20 is disposed so as to penetrate through the bearing housing 100 in the front-back direction. The compressor 30 is disposed at the back of the bearing housing 100, and the turbine 40 is disposed at the front of the bearing housing 100.

The compressor housing 60 is for containing the compressor 30. The compressor housing 60 is fixed to a back portion of the bearing housing 100, and is formed to cover the compressor 30.

The turbine housing 70 is for containing the turbine 40. The turbine housing 70 is fixed to a front portion of the bearing housing 100, and is formed to cover the turbine 40.

The sliding bearing 80 is interposed between the shaft 20 and the bearing housing 100, and is for turning the shaft 20 smoothly. The sliding bearing 80 is formed of a copper-based material.

The color turbo seal 81 is a member through which the shaft 20 is inserted at the back of the sliding bearing 80. The thrust bearing 82 is externally fitted onto the color turbo seal 81 at the back of the sliding bearing 80, and the retainer seal 83 is externally fitted onto the color turbo seal 81 at the back of the thrust bearing 82.

Next, with reference to FIGS. 2 to 16, description will be given of a configuration of the bearing housing 100.

The bearing housing 100 mainly includes a compressor-side housing 110, a turbine-side housing 120, and a metal gasket 150. The compressor-side housing 110 and the turbine-side housing 120 are disposed side by side and fixed in the front-back direction, thereby configuring the bearing housing 100.

The compressor-side housing 110 shown in FIGS. 2 to 8 is a member which configures a portion of a compressor 30 side in the bearing housing 100. The compressor-side housing 110 mainly includes a body portion 111 and a flange portion 112.

The body portion 111 is a portion formed into a roughly cylindrical shape such that the axis thereof is directed toward the front-back direction. At a lower portion of the body portion 111, a lower surface (bottom surface) that is a plane surface parallel to the front-back and the left-right directions is formed. In the body portion 111, an O-ring groove 111*a*, a bearing portion 111*b*, and a heat sink portion 111*c* are formed.

The O-ring groove 111*a* is formed at a roughly central portion of a back surface of the body portion 111, and is a recess having a predetermined depth. A cross-section (back view) of the O-ring groove 111*a* is formed to be a roughly circular shape.

The bearing portion 111*b* is a portion for turnably supporting the shaft 20. The bearing portion 111*b* includes a through-hole which is formed so as to penetrate through the body portion 111 in the front-back direction. More specifically, the bearing portion 111*b* is formed so as to communicate a front surface of the body portion 111 with a thrust bearing oil passage 143*a* to be described later, and additionally formed to be parallel to the front-back direction.

The heat sink portion 111*c* is a portion for dissipating heat transferred to the compressor-side housing 110. The heat sink portion 111*c* is formed on an outer peripheral surface of the body portion 111 (more specifically, front and back surfaces of the body portion 111 and a surface except a plane surface formed at the lower portion of the body portion 111). The heat sink portion 111*c* is formed to arrange a plurality of plate-shaped (fin-shaped) portions on the outer peripheral surface of the body portion 111.

The flange portion 112 is a portion formed into a roughly disc shape such that the plate surface thereof is directed toward the front-back direction. The flange portion 112 is integrally formed with the body portion 111 on the back end periphery of the body portion 111.

The compressor-side housing 110 configured as described above is formed of an aluminum die cast (die cast using an aluminum-based material).

The turbine-side housing 120 shown in FIGS. 2, 3, and 9 to 12 is a member which configures a portion of a turbine 40 side in the bearing housing 100. The turbine-side housing 120 mainly includes a flange portion 121, and a thick wall portion 122.

The flange portion 121 is a portion formed into a roughly disc shape such that the plate surface thereof is directed toward the front-back direction.

The thick wall portion 122 is a portion formed such that the plate thickness of a central portion of the flange portion 121 formed in a roughly disc shape is thicker than the plate thickness of other portions. More specifically, the thick wall portion 122 is formed into a roughly cylindrical shape such that the axis thereof is directed toward the front-back direction. The thick wall portion 122 is formed so as to protrude from a front surface of the flange portion 121 in the front direction. The thick wall portion 122 is integrally formed with the flange portion 121. The thick wall portion 122 is formed with a through-hole 122*a*.

The through-hole 122*a* is formed so as to penetrate through the thick wall portion 122 of the turbine-side housing 120 in the front-back direction.

The turbine-side housing 120 configured as described above is formed by a sheet metal process using stainless steel.

In the compressor-side housing 110 and the turbine-side housing 120 configured as described above, as shown in FIGS. 2, 3, and 13 to 16, in a state where a front surface of the compressor-side housing 110 and a back surface of the turbine-side housing 120 abut on each other, by fastening (fixing) a fastening tool such as a bolt, a diffusion bonding or the like, the bearing housing 100 is formed.

Under the circumstance, the metal gasket 150 that is a gasket made of metal is interposed between the compressor-side housing 110 and the turbine-side housing 120, thereby retaining a liquid tightness between the compressor-side housing 110 and the turbine-side housing 120.

Further, the sliding bearing 80 is inserted into the inside of the bearing portion 111*b* formed in the compressor-side housing 110 of the bearing housing 100, and further the shaft 20 is inserted into the inside of the sliding bearing 80. Thus, the sliding bearing 80 is interposed between the shaft 20 and the bearing housing 100 (more specifically, the bearing portion 111*b*).

In the turbocharger 10 having the bearing housing 100 configured as described above, when the turbine 40 is rotated by exhaust of an engine, the temperature of the bearing housing 100 also becomes high due to the high-temperature exhaust. At this time, the temperature of a portion near the turbine 40 rotated by the exhaust, namely the turbine-side housing 120 in the bearing housing 100 particularly becomes high. Since the turbine-side housing 120 according to the present embodiment is formed of stainless steel, the turbine-side housing 120 is resistant to heat and is capable of resisting the high temperature caused by the exhaust of the engine.

A portion near the turbine 40 in the bearing housing 100 is configured with the turbine-side housing 120 formed of stainless steel so that it is possible to insulate (shield) exhaust heat in the turbine-side housing 120 and to prevent heat from easily transferring to the compressor-side housing 110. Further, according to the present embodiment, the metal gasket 150 is interposed between the compressor-side housing 110 and the turbine-side housing 120, and thereby the metal gasket 150 is capable of shielding heat. Thus, it is more possible to prevent heat from easily transferring to the compressor-side housing 110.

Further, since a portion far from the turbine 40 in the bearing housing 100, namely the compressor-side housing 110 has a heat shielding effect from the turbine-side housing 120, the compressor-side housing 110 does not easily become a high temperature, compared to the turbine-side housing 120. Accordingly, as the present embodiment, the compressor-side housing 110 can be formed of an aluminum-based material which is comparatively weak to heat compared to stainless steel. Thereby, it is possible to reduce the weight of the bearing housing 100 and to improve workability thereof.

Further, in the compressor-side housing 110, since the heat sink portion 111*c* for easily dissipating heat is formed therein, it is possible to effectively suppress a temperature rise in the compressor-side housing 110 (specifically, the bearing housing 100).

Generally, in a portion for rotating at high speed using a sliding bearing (in the present embodiment, in the bearing portion 111*b* of the compressor-side housing 110, a portion in which the shaft 20 is turnably supported via the sliding bearing 80), whirl vibration may occur. When the whirl vibration occurs, noise (abnormal sound) may occur due to the whirl vibration. Accordingly, it is important to reduce the whirl vibration.

In the present embodiment, by rotating the shaft 20 at high speed and transferring exhaust heat from the turbine 40 side, the temperature of the bearing portion 111*b* (more specifically, the bearing portion 111*b*, the sliding bearing 80 and the shaft 20 supported in the bearing portion 111*b*) rises. Thereby, each of the bearing portion 111*b*, the sliding bearing 80, and the shaft 20 expands (expands thermally).

A coefficient of thermal expansion of the sliding bearing 80 (copper-based material) is larger than that of the shaft 20 (steel material). A coefficient of thermal expansion of the bearing portion 111*b* (aluminum-based material) is larger than that of the sliding bearing 80 (copper-based material). Accordingly, an inner diameter of the sliding bearing 80 is expanded larger than an outer diameter of the shaft 20, and an inner diameter of the bearing portion 111*b* is expanded larger than an outer diameter of the sliding bearing 80. Thus, the amount of the lubricating oil interposed between the sliding bearing 80 and the shaft 20, and the amount of the lubricating oil interposed between the bearing portion 111*b* and the sliding bearing 80 are both increased. Thereby, it is possible to reduce the whirl vibration.

According to the present embodiment, by forming the bearing portion 111*b* with an aluminum-based material having a high thermal conductivity, heat generated in the bearing portion 111*b* is effectively absorbed and conducted (for example, dissipated from the heat sink portion 111*c*), and thereby a temperature rise of the bearing portion 111*b* can be suppressed. Thus, it is possible to effectively prevent deformation, damage, and the like, which are caused by heat, of the bearing portion 111*b*.

A lubricating oil passage 140 for supplying lubricating oil to the bearing portion 111*b* will be described later.

Next, with reference to FIGS. 2 to 8, and 11 to 16, description will be given of a cooling water passage 130 and the lubricating oil passage 140 which are formed in the bearing housing 100.

The cooling water passage 130 is for supplying cooling water for cooling the bearing housing 100 to the inside of the bearing housing 100. The cooling water passage 130 mainly includes a compressor-side arc-shaped cooling water passage 131, a turbine-side arc-shaped cooling water passage 132, a water supply passage 133, and a water discharge passage 134.

The compressor-side arc-shaped cooling water passage 131 shown in FIGS. 4 to 8 is one embodiment of an arc-shaped cooling water passage according to the present invention, and is a groove formed on a front surface of the body portion 111 in the compressor-side housing 110. The compressor-side arc-shaped cooling water passage 131 is formed, in a front view (refer to FIG. 5), so as to have a shape (arc shape) such that a bottom portion of a circular shape centered around the bearing portion 111*b* is cut out. The front surface of the body portion 111 in the compressor-side housing 110 is subjected to machining such as cutting and grinding to thereby form the compressor-side arc-shaped cooling water passage 131.

Figure 11:
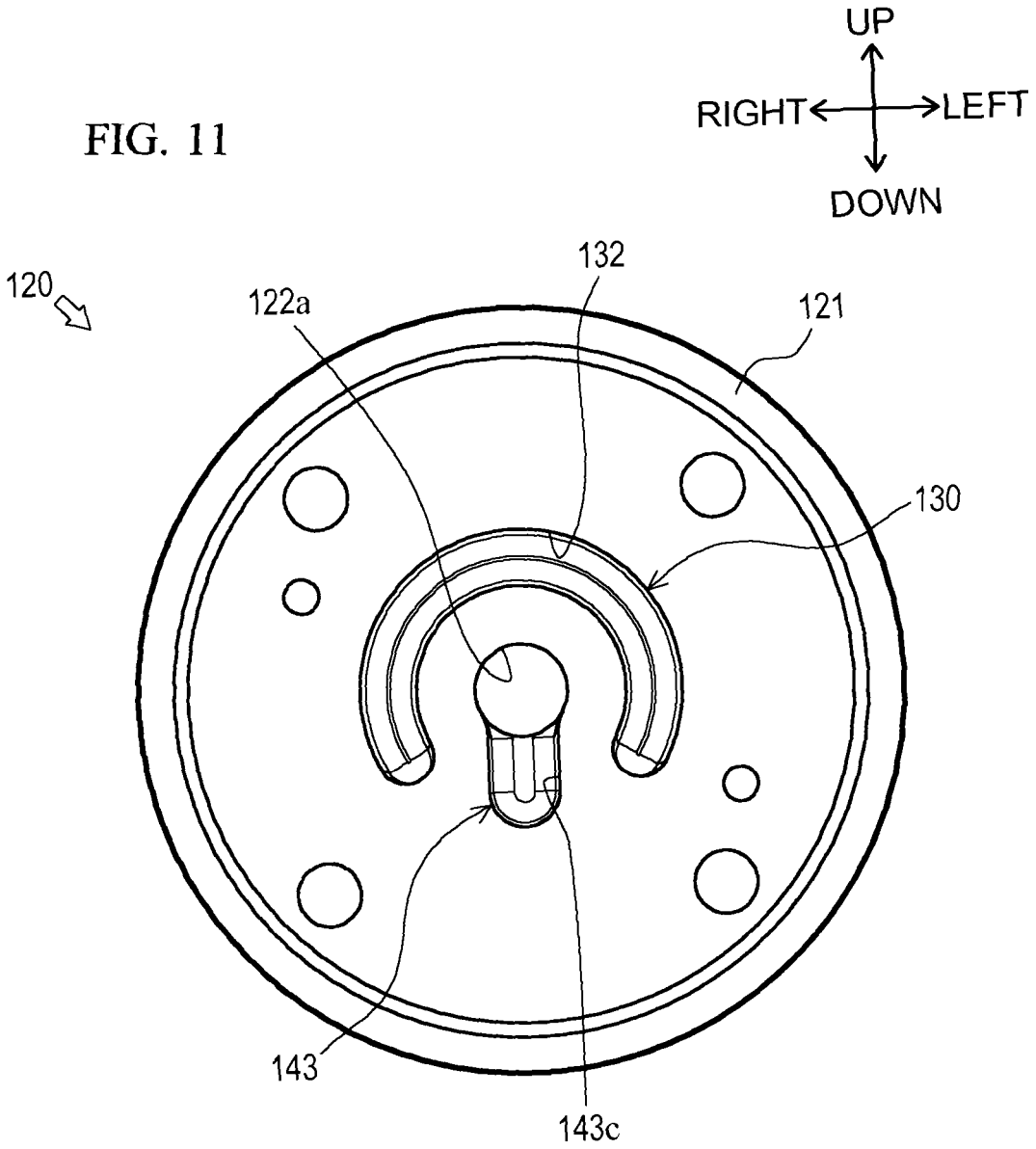
FIG. 11 is a back view of the turbine-side housing.
Figure 12A:
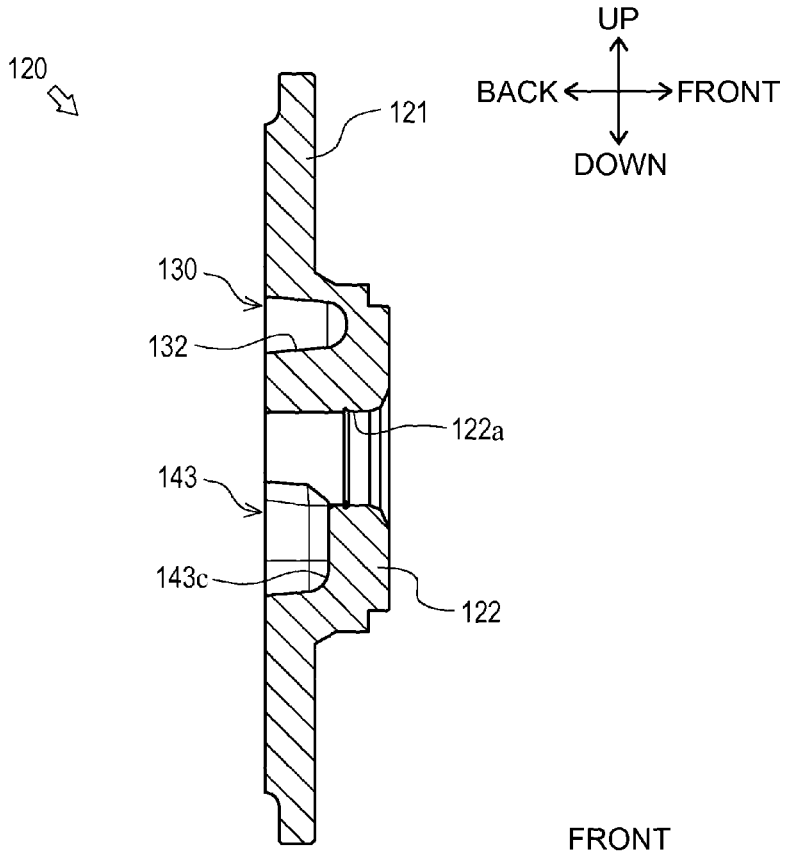
FIG. 12A is a cross-sectional view of the turbine-side housing taken along line D-D of FIG. 10A.
Figure 12B:
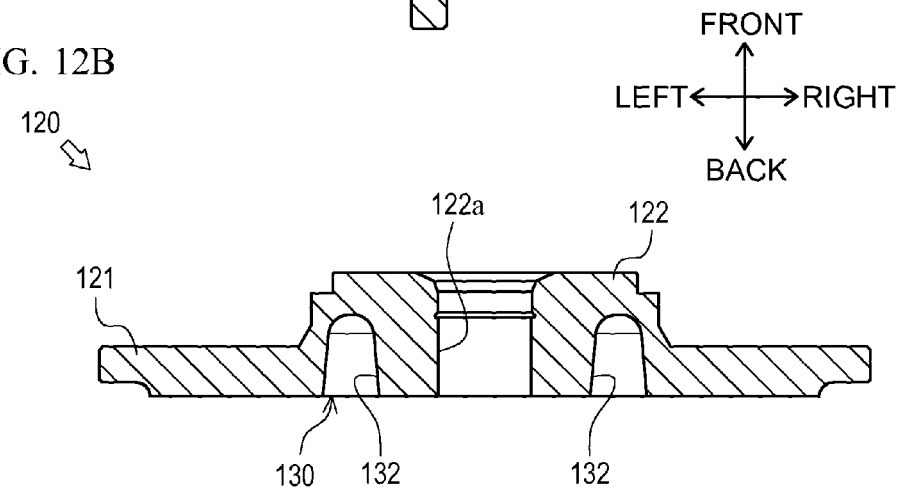
FIG. 12B is a cross-sectional view of the turbine-side housing taken along line E-E of FIG. 10A.
Figure 13A:
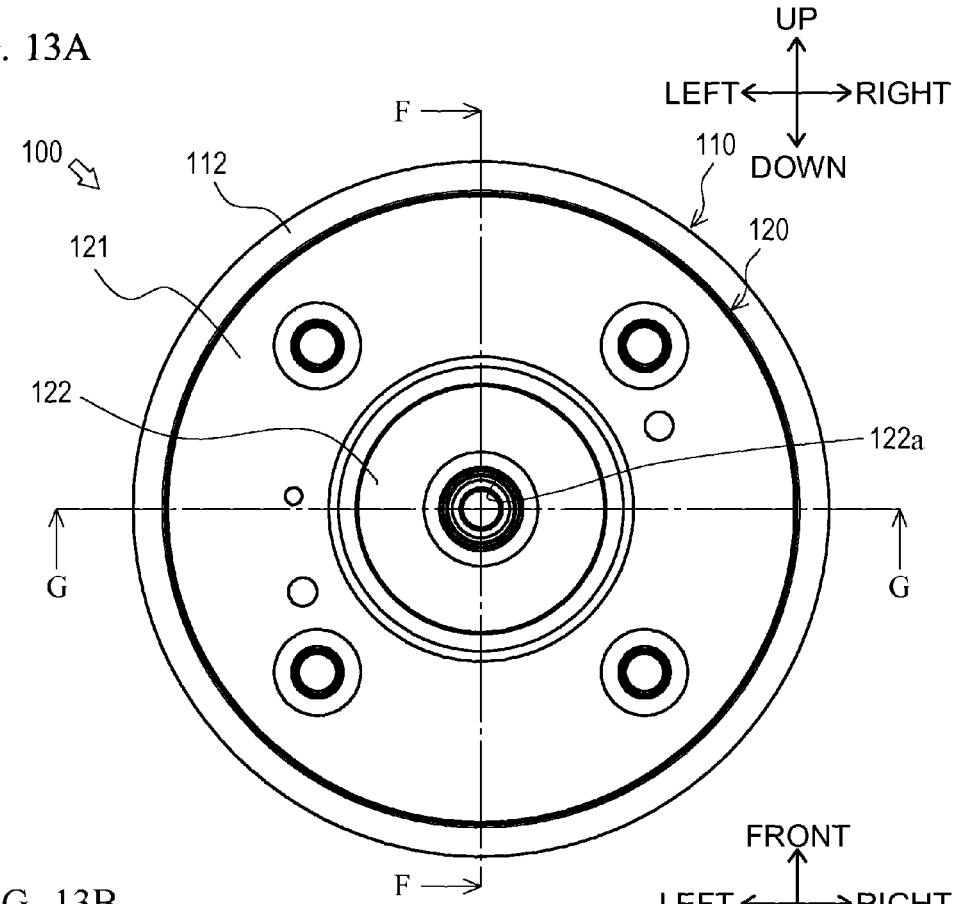
FIG. 13A is a front view of the bearing housing.
Figure 13B:
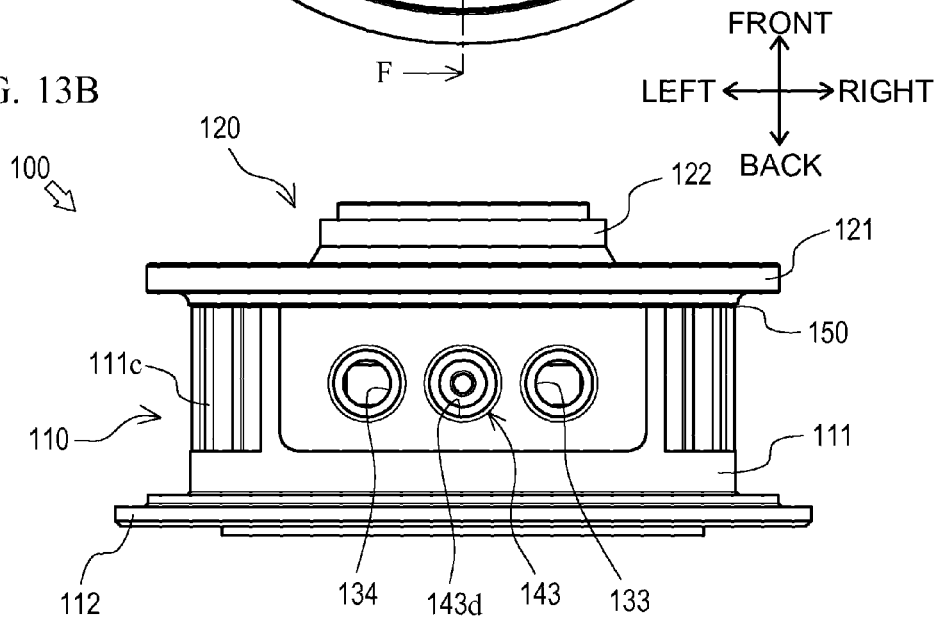
FIG. 13B is a bottom view of the bearing housing.
Figure 14:
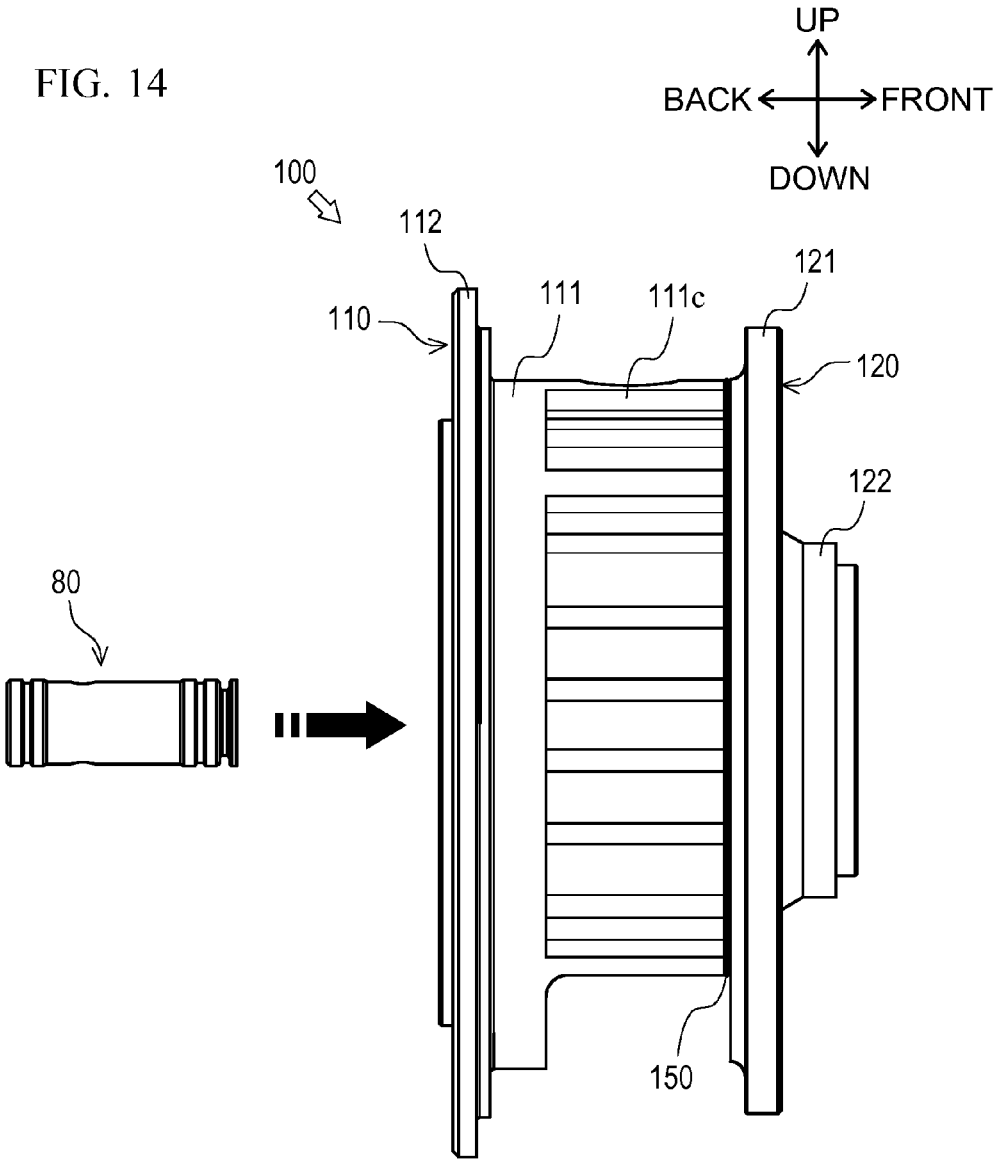
FIG. 14 is a left-side view of the bearing housing.
Figure 15:
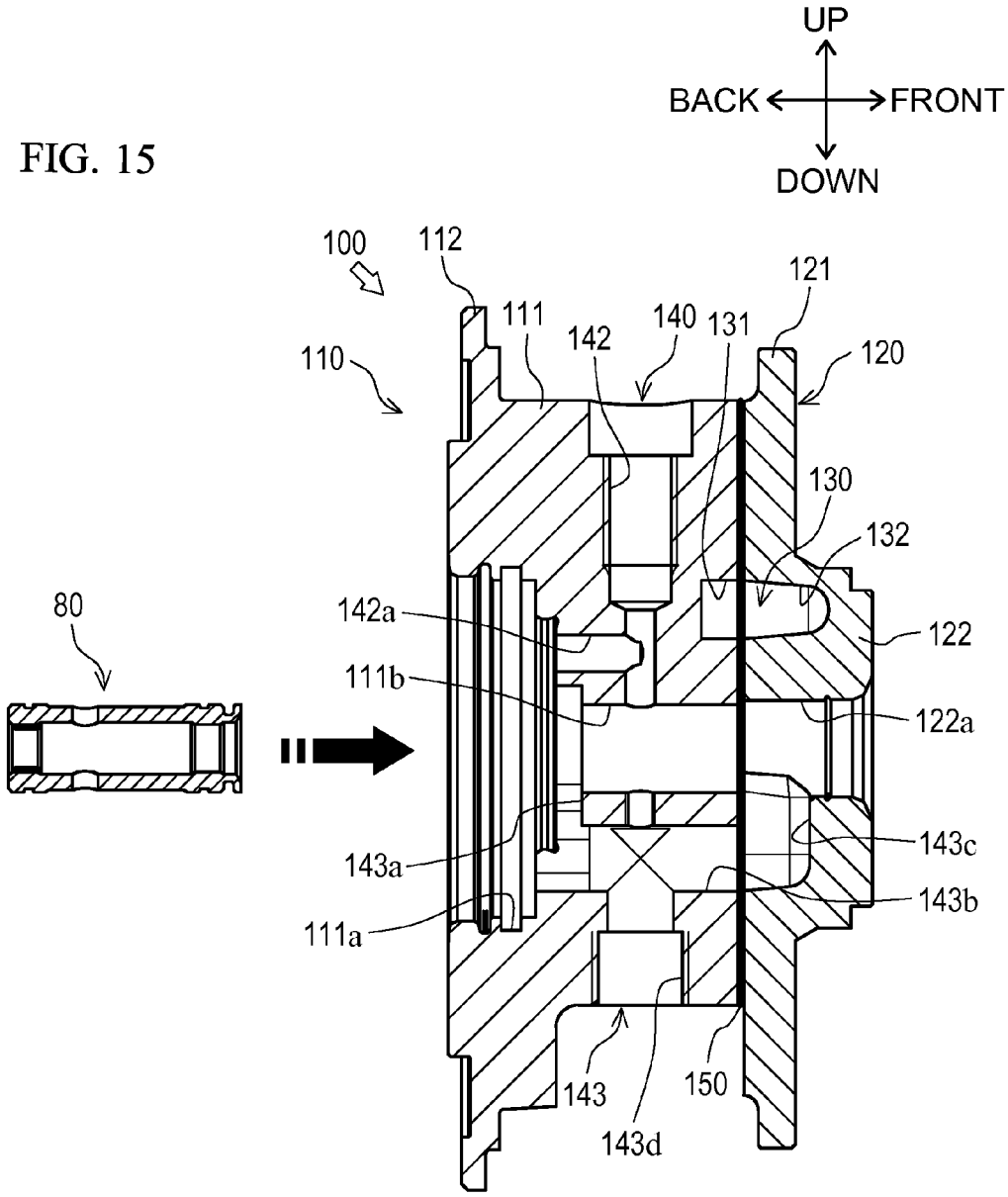
FIG. 15 is a cross-sectional view of the bearing housing taken along line F-F of FIG. 13A.
Figure 16:
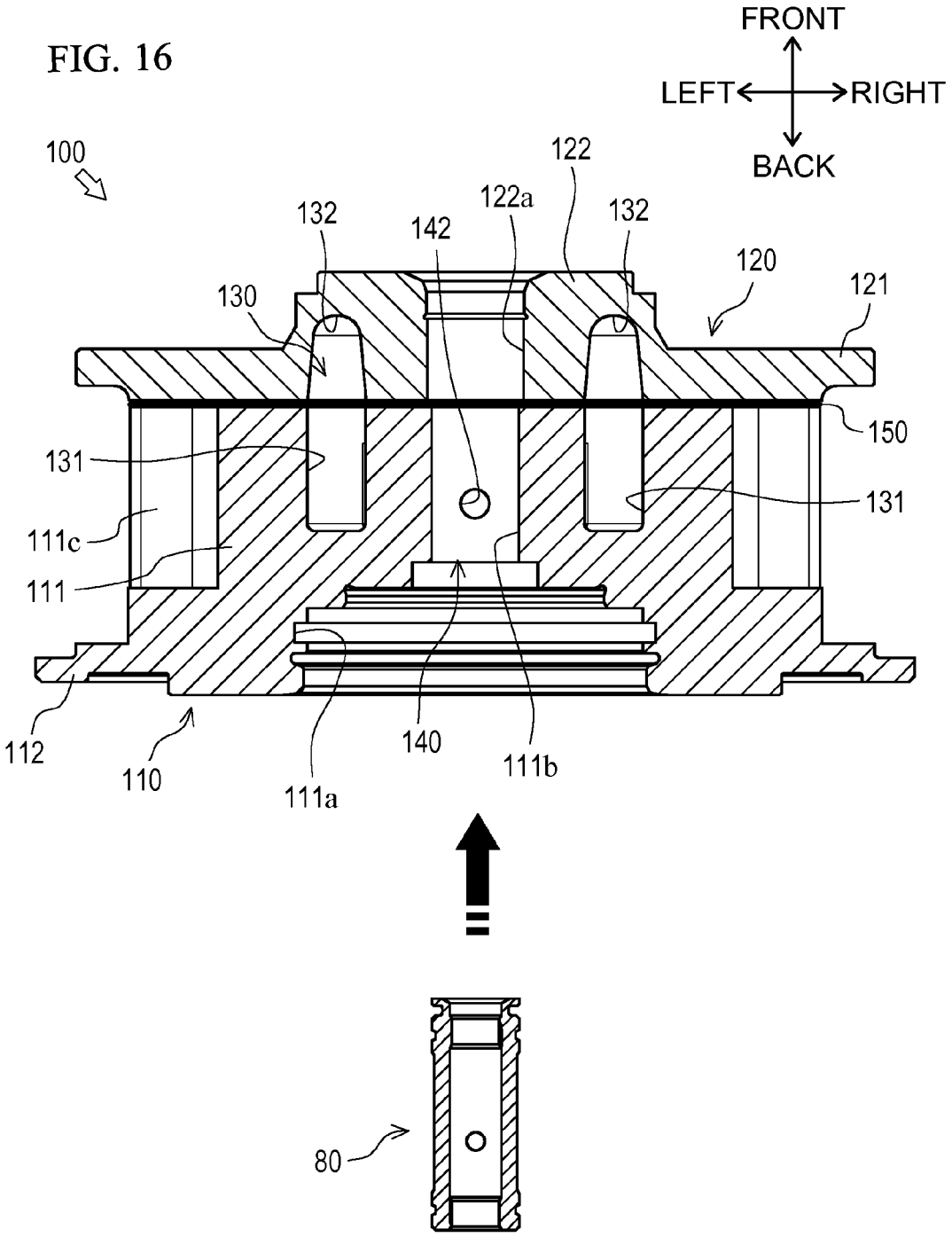
FIG. 16 is a cross-sectional view of the bearing housing taken along line G-G of FIG. 13A.

The turbine-side arc-shaped cooling water passage 132 shown in FIG. 11 and FIG. 12 is one embodiment of an arc-shaped cooling water passage according to the present invention and is a groove formed on a back surface of the thick wall portion in the turbine-side housing 120. The turbine-side arc-shaped cooling water passage 132 is formed, in a back view (refer to FIG. 11), so as to have a shape (arc shape) such that a bottom portion of a circular shape centered around the through-hole 122*a* is cut out. The turbine-side arc-shaped cooling water passage 132 is formed so as to correspond to the compressor-side arc-shaped cooling water passage 131 formed in the compressor-side housing 110 (refer to FIG. 5). The back surface of the thick wall portion 122 in the turbine-side housing 120 is subjected to machining such as cutting and grinding, or press working to thereby form the turbine-side arc-shaped cooling water passage 132.

Figure 5A:
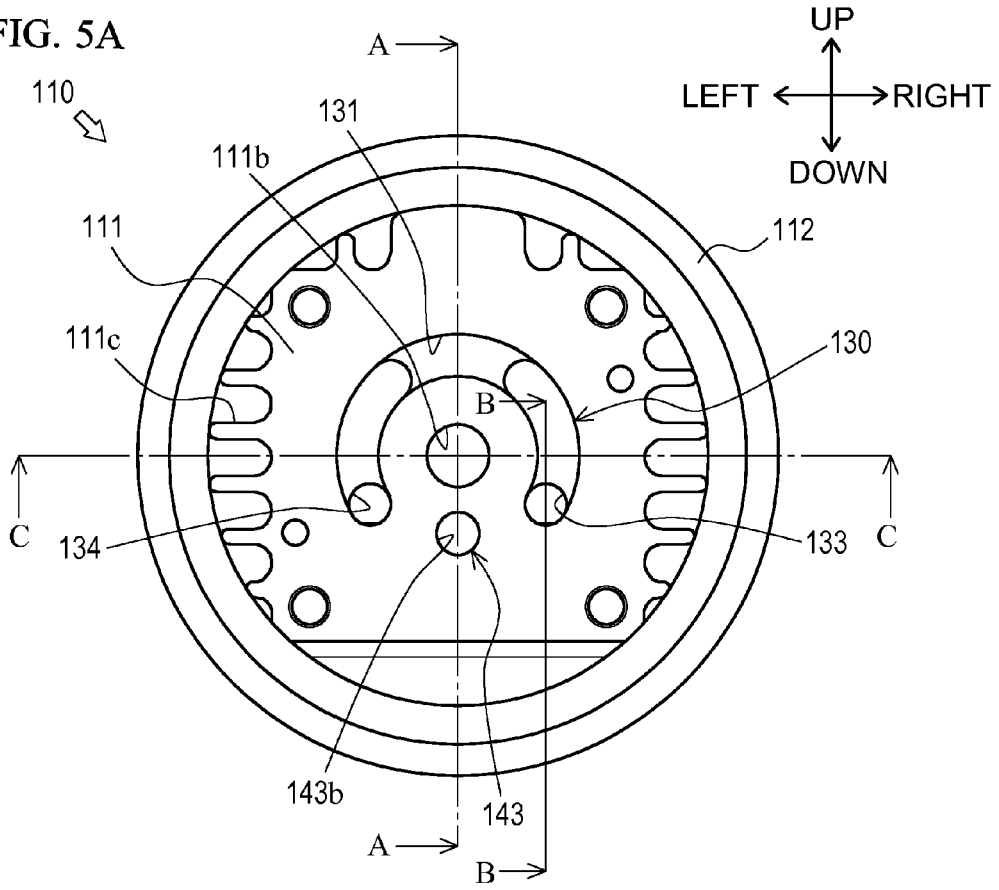
FIG. 5A is a front view of the compressor-side housing.
Figure 5B:
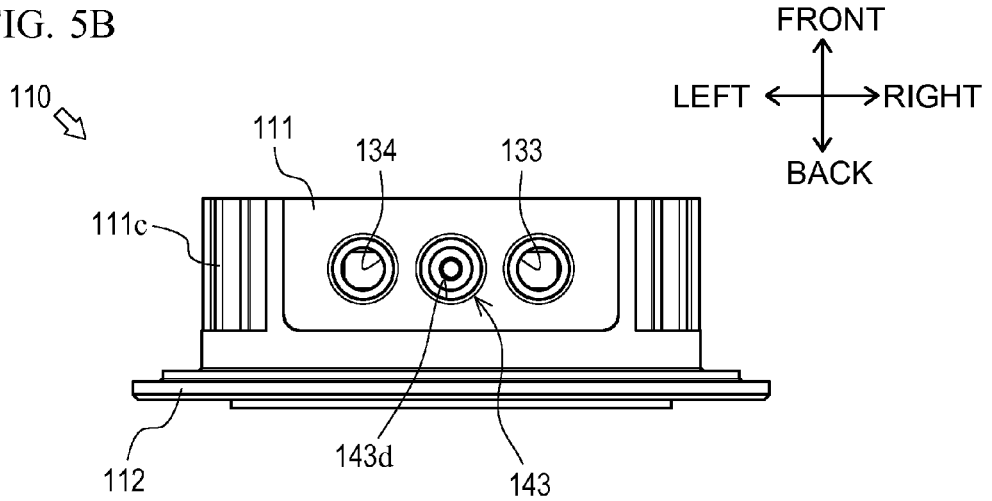
FIG. 5B is a bottom view of the compressor-side housing.
Figure 8A:
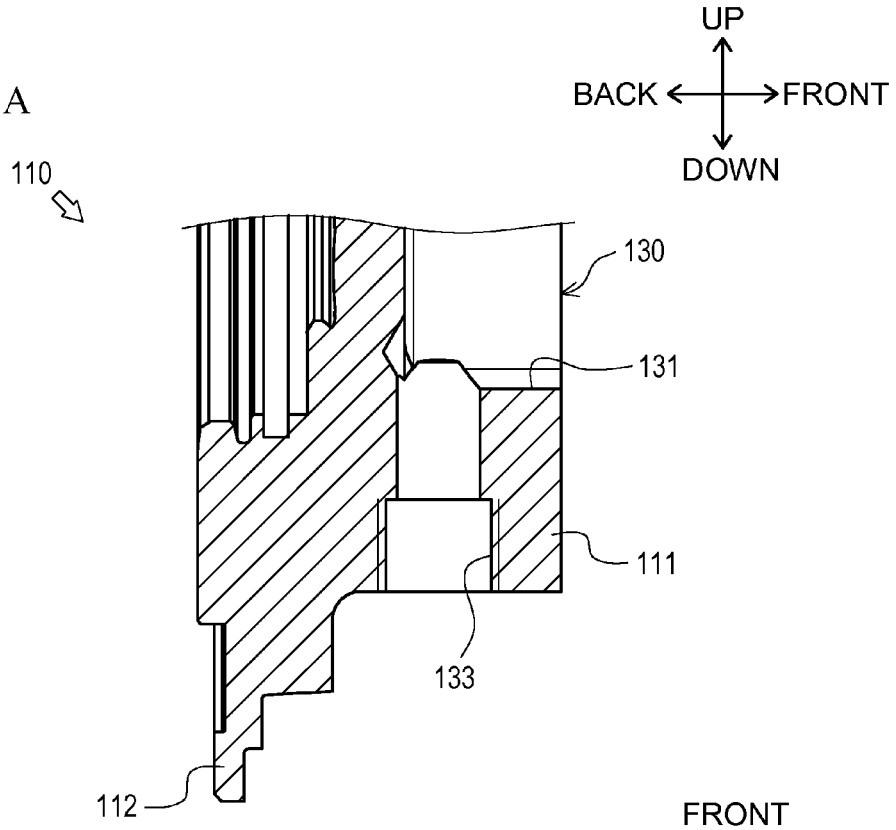
FIG. 8A is a cross-sectional view of the compressor-side housing taken along line B-B of FIG. 5A.
Figure 8B:
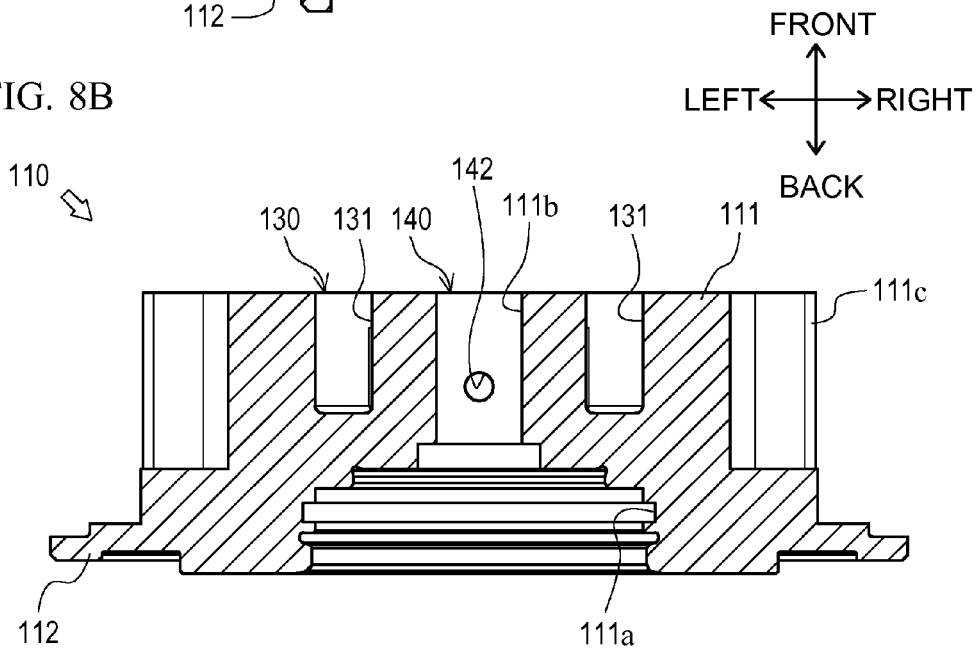
FIG. 8B is a cross-sectional view of the compressor-side housing taken along line C-C of FIG. 5A.
Figure 9:
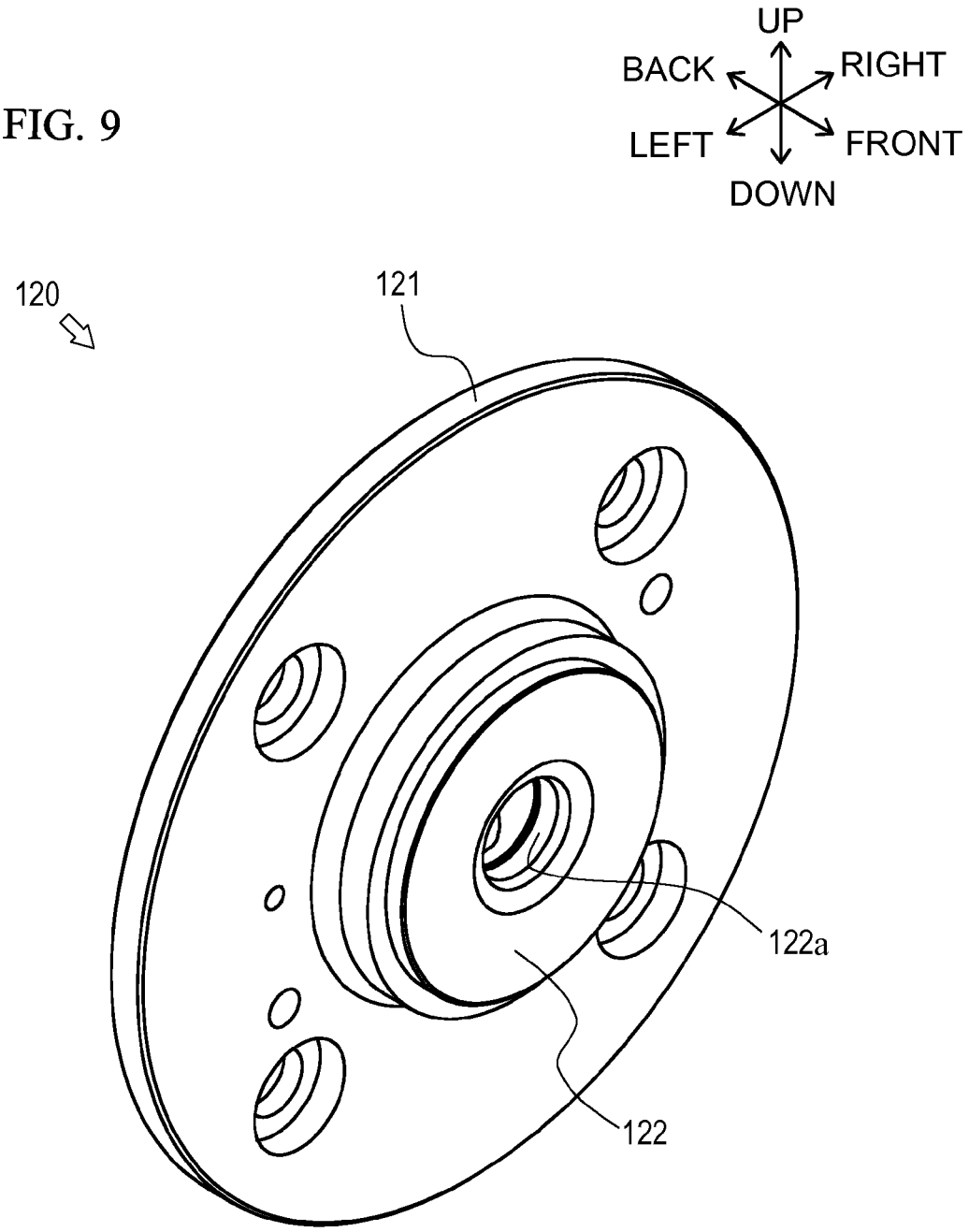
FIG. 9 is a perspective view of a turbine-side housing.
Figure 10B:
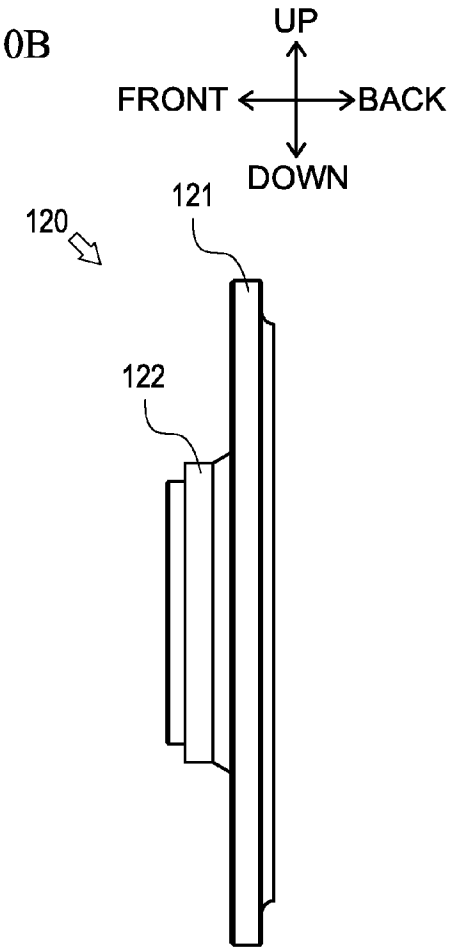
FIG. 10B is a right-side view of the turbine-side housing.
Figure 10A:
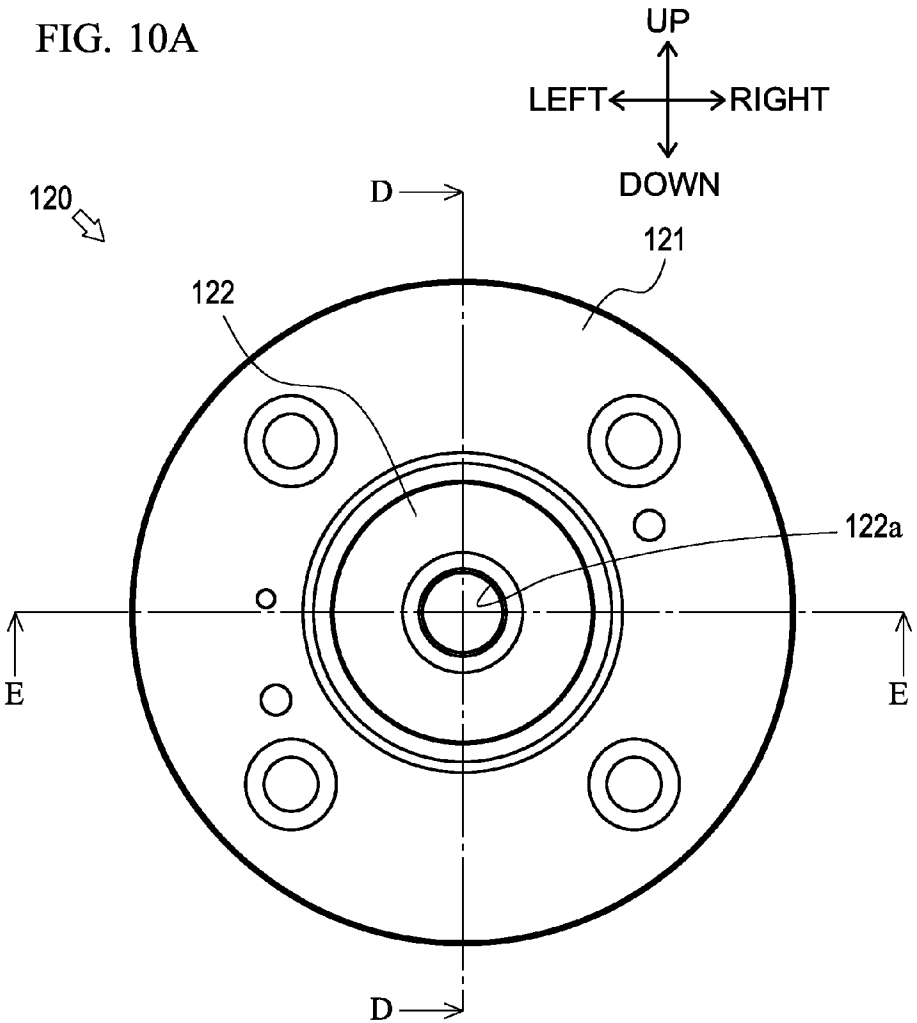
FIG. 10A is a front view of the turbine-side housing.

The water supply passage 133 shown in FIG. 5 and FIG. 8 is formed in the compressor-side housing 110, and is for communicating the compressor-side arc-shaped cooling water passage 131 with a bottom surface of the body portion 111 in the compressor-side housing 110. More specifically, the water supply passage 133 is formed so as to communicate a neighborhood of a right end portion of the bottom surface of the body portion 111 in the compressor-side housing 110 with a right end portion of the compressor-side arc-shaped cooling water passage 131. The front surface of the body portion 111 in the compressor-side housing 110 (more specifically, inside of the compressor-side arc-shaped cooling water passage 131) and the bottom surface of the body portion 111 in the compressor-side housing 110 are subjected to machining such as cutting and grinding to thereby form the water supply passage 133.

The water discharge passage 134 shown in FIG. 5 is formed in the compressor-side housing 110, and is for communicating the compressor-side arc-shaped cooling water passage 131 with the bottom surface of the body portion 111 in the compressor-side housing 110. More specifically, the water discharge passage 134 is formed so as to communicate a neighborhood of a left end portion of the bottom surface of the body portion 111 in the compressor-side housing 110 with a left end portion of the compressor-side arc-shaped cooling water passage 131. The front surface of the body portion 111 in the compressor-side housing 110 (more specifically, inside of the compressor-side arc-shaped cooling water passage 131) and the bottom surface of the body portion 111 in the compressor-side housing 110 are subjected to machining such as cutting and grinding to thereby form the water discharge passage 134.

As shown in FIGS. 3, and 13 to 16, by fastening (fixing) the compressor-side housing 110 with the turbine-side housing 120, the water supply passage 133, the compressor-side arc-shaped cooling water passage 131, the turbine-side arc-shaped cooling water passage 132, and the water discharge passage 134 are communicatively connected with each other. Thereby, the cooling water passage 130 is formed.

In the cooling water passage 130 formed as described above, cooling water is supplied to the inside of the bearing housing 100 via the water supply passage 133. The cooling water is supplied from the water supply passage 133 to one end portion of the compressor-side arc-shaped cooling water passage 131 (right lower end portion in FIG. 5A), and to one end portion of the turbine-side arc-shaped cooling water passage 132 (right lower end portion in FIG. 11).

The cooling water circulates inside the compressor-side arc-shaped cooling water passage 131 and inside the turbine-side arc-shaped cooling water passage 132, and then the cooling water is supplied to the other end portion of the compressor-side arc-shaped cooling water passage 131 (left lower end portion in FIG. 5A) and to the other end portion of the turbine-side arc-shaped cooling water passage 132 (left lower end portion in FIG. 11). At this time, the compressor-side arc-shaped cooling water passage 131 and the turbine-side arc-shaped cooling water passage 132 are formed so as to be an arc shape centered at the bearing portion 111*b* and the through-hole 122*a* (specifically, the shaft 20). Accordingly, heat transferred from the turbine 40 side via the shaft 20 and heat generated by the rotation of the shaft 20 can be cooled effectively.

The cooling water is supplied from the other end portion of the compressor-side arc-shaped cooling water passage 131 and the other end portion of the turbine-side arc-shaped cooling water passage 132 to the water discharge passage 134. The cooling water is discharged from the water discharge passage 134 to the outside of the bearing housing 100.

As described above, by circulating cooling water inside the cooling water passage 130, a temperature rise of the bearing housing 100 can be suppressed effectively.

A lubricating oil passage 140 is for supplying lubricating oil for lubricating a sliding portion between the bearing housing 100 and the shaft 20 to the inside of the bearing housing 100. The lubricating oil passage 140 mainly includes the bearing portion 111*b*, a second lubricating oil passage 142, and a first lubricating oil passage 143.

The bearing portion 111*b* shown in FIGS. 4 to 8 is a through-hole which is formed so as to penetrate through the body portion 111 in the compressor-side housing 110 in the front-back direction as described above. The bearing portion 111*b* is a portion for turnably supporting the shaft 20, and is also a portion for forming a part of the lubricating oil passage 140. The compressor-side housing 110 (more specifically, inside of the thrust bearing oil passage 143*a* to be described later) is subjected to machining such as cutting and grinding from the front surface or the back surface thereof to thereby form the bearing portion 111*b*.

Figure 4:
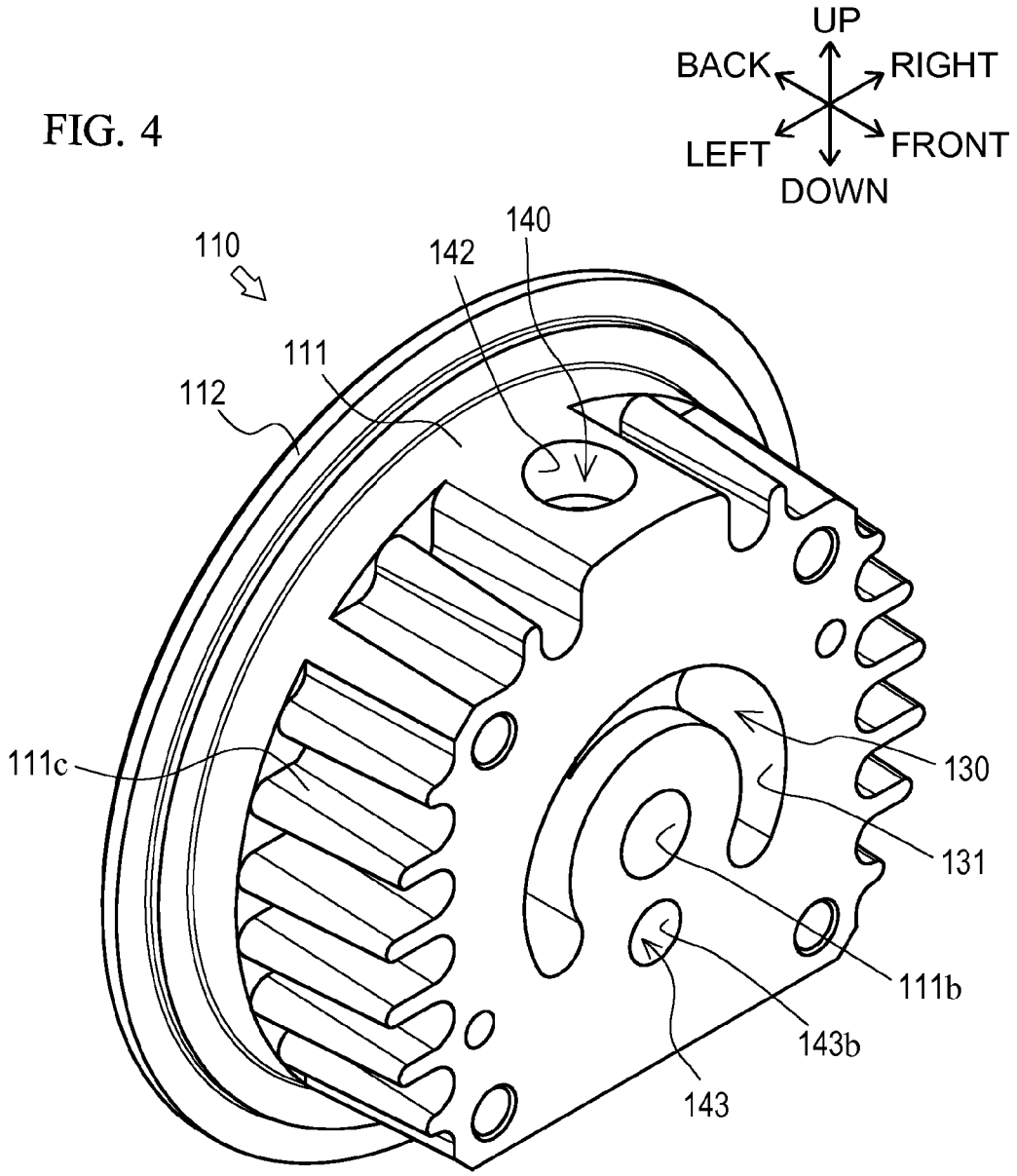
FIG. 4 is a perspective view of a compressor-side housing.
Figure 7B:
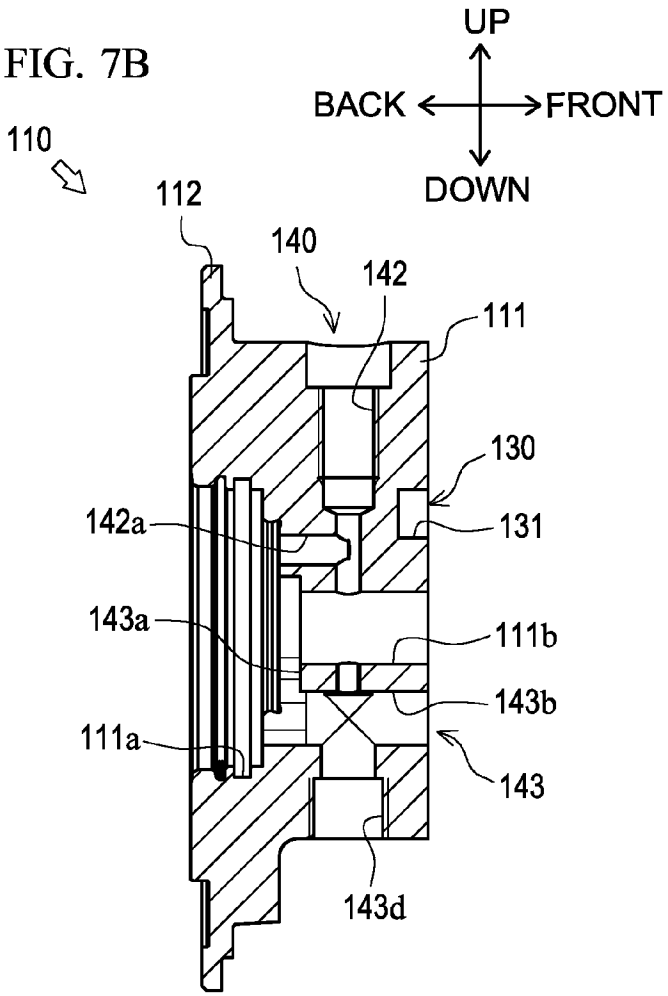
FIG. 7B is a cross-sectional view of the compressor-side housing taken along line A-A of FIG. 5A.
Figure 7A:
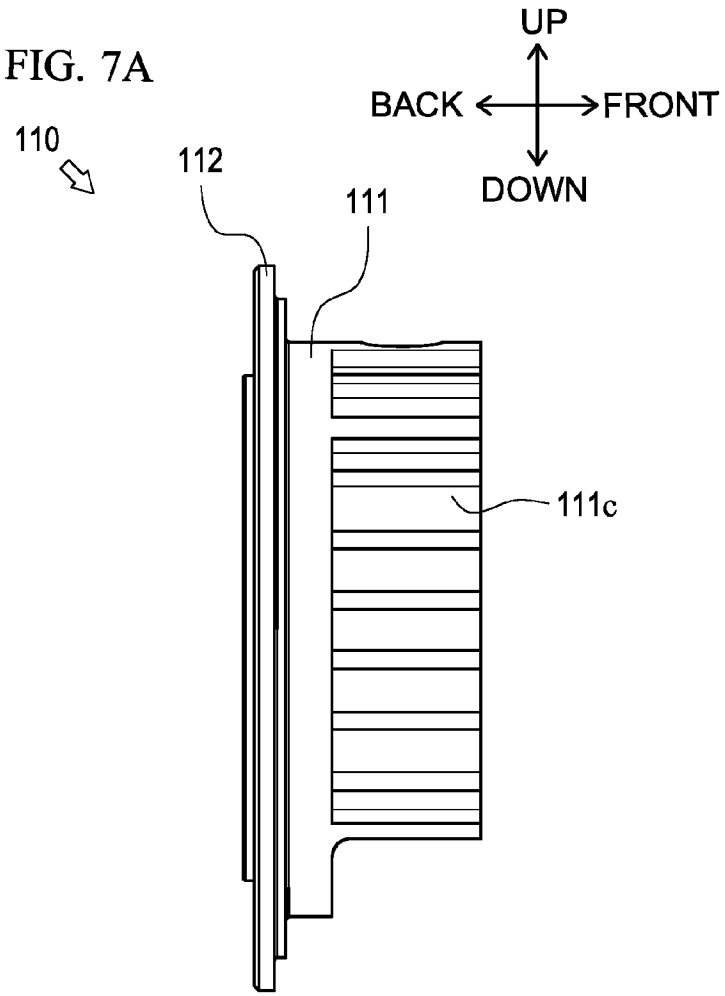
FIG. 7A is a left-side view of the compressor-side housing.

The second lubricating oil passage 142 shown in FIGS. 4, 7, and 8 is for communicating an upper surface of the bearing housing 100 with the bearing portion 111*b*. More specifically, the second lubricating oil passage 142 is formed so as to communicate a roughly central portion of an upper surface (upper portion) of the body portion 111 in the compressor-side housing 110 with a roughly central portion in the front-back direction of the bearing portion 111*b*. The upper surface (upper portion) of the body portion 111 in the compressor-side housing 110 is subjected to machining such as cutting and grinding to thereby form the second lubricating oil passage 142.

In a middle portion of the second lubricating oil passage 142, a compressor-side branch oil passage 142*a* is formed so as to be branched therefrom. The compressor-side branch oil passage 142*a* communicates a middle portion in the vertical direction of the second lubricating oil passage 142 with a thrust bearing oil passage 143*a* to be described later. The thrust bearing oil passage 143*a* to be described later is subjected to machining such as cutting and grinding to thereby form the compressor-side branch oil passage 142*a*.

The first lubricating oil passage 143 shown in FIGS. 4 to 7, 11, and 12 is for communicating a lower surface of the bearing housing 100 with the bearing portion 111*b*. The first lubricating oil passage 143 mainly includes a thrust bearing oil passage 143*a*, a compressor-side horizontal oil passage 143*b*, a turbine-side vertical oil passage 143*c*, and a discharge oil passage 143*d*.

Figure 6:
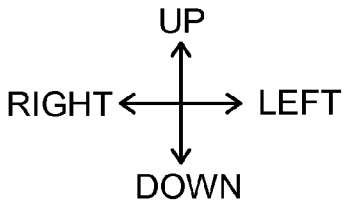
FIG. 6 is a back view of the compressor-side housing.
Figure 6:
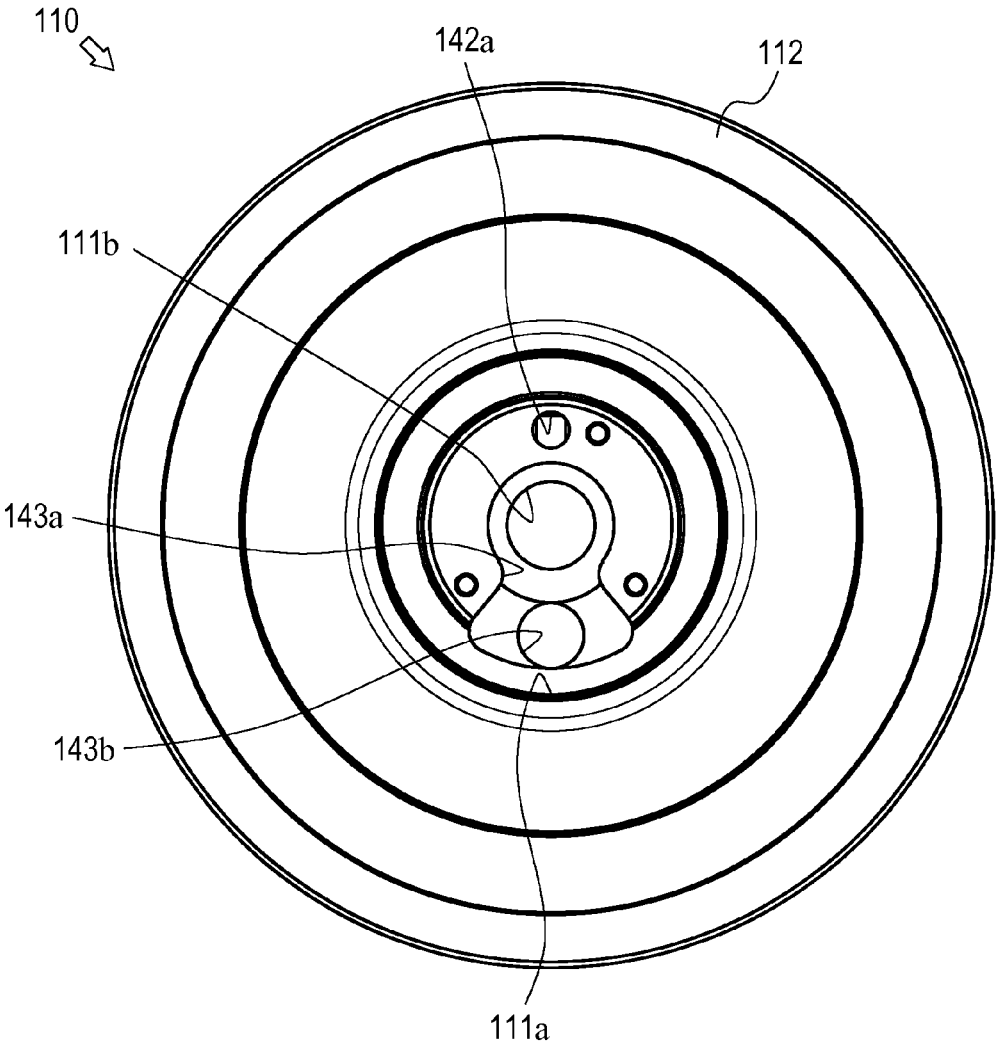

The thrust bearing oil passage 143*a* shown in FIG. 6 and FIG. 7 is a groove which is formed by cutting out, in the vertical direction, the inside of the O-ring groove 111*a* (back portion of the body portion 111) formed in the body portion 111 of the compressor-side housing 110. More specifically, the thrust bearing oil passage 143*a* is formed such that the body portion 111 is deeply cut out in the front direction from the roughly central portion of a back portion of the body portion 111 (back end portion of the bearing portion 111*b* (end portion at the compressor 30 side)) to the lower portion. The back surface of the compressor-side housing 110 (more specifically, inside of the O-ring groove 111*a*) is subjected to machining such as cutting and grinding to thereby form the thrust bearing oil passage 143*a*.

The compressor-side horizontal oil passage 143*b* shown in FIGS. 4 to 7 is a through-hole which is formed so as to penetrate through the body portion 111 of the compressor-side housing 110 in the front-back direction. More specifically, the compressor-side horizontal oil passage 143*b* is formed so as to communicate the front surface of the body portion 111 with the thrust bearing oil passage 143*a*, and is further formed in the lower direction of the bearing portion 111*b* so as to be parallel to the bearing portion 111*b*. The compressor-side housing 110 (more specifically, inside of the thrust bearing oil passage 143*a*) is subjected to machining such as cutting and grinding, or casting using a casting mold from the front surface or the back surface thereof to thereby form the compressor-side horizontal oil passage 143*b*.

The turbine-side vertical oil passage 143*c* shown in FIG. 11 and FIG. 12 is a groove which is formed by cutting out a back surface of the thick wall portion 122 of the turbine-side housing 120 in the vertical direction. More specifically, the turbine-side vertical oil passage 143*c* is formed from a roughly central portion of the back surface of the thick wall portion 122 (through-hole 122*a*) to a lower portion. The back surface of the turbine-side housing 120 is subjected to machining such as cutting and grinding, or press working to thereby form the turbine-side vertical oil passage 143*c*.

The discharge oil passage 143*d* shown in FIG. 5 and FIG. 7 is formed in the compressor-side housing 110, and is for communicating the compressor-side horizontal oil passage 143*b* with the bottom surface of the body portion 111 of the compressor-side housing 110. More specifically, the discharge oil passage 143*d* is formed so as to communicate the right and left central portions of the bottom surface of the body portion 111 in the compressor-side housing 110 with a roughly central portion in the front-back direction of the compressor-side horizontal oil passage 143*b*. The bottom surface of the body portion 111 in the compressor-side housing 110 is subjected to machining such as cutting and grinding to thereby form the discharge oil passage 143*d*.

As shown in FIGS. 3, 13 to 16, when the compressor-side housing 110 and the turbine-side housing 120 are fastened (fixed), the thrust bearing oil passage 143*a*, the compressor-side horizontal oil passage 143*b*, the turbine-side vertical oil passage 143*c*, and the discharge oil passage 143*d* are communicatively connected to each other. Thus, the second lubricating oil passage 143 is formed. Further, the second lubricating oil passage 142, the bearing portion 111*b*, and the first lubricating oil passage 143 form the lubricating oil passage 140.

The lubricating oil passage 140 according to the present embodiment is subjected to a process for reducing a surface roughness of the lubricating oil passage 140 (for example, precision grinding, coating, and the like).

In the lubricating oil passage 140 formed as described above, lubricating oil is supplied from an upper surface of the bearing housing 100 (compressor-side housing 110) via the second lubricating oil passage 142 to the inside of the bearing housing 100. The lubricating oil circulates inside the second lubricating oil passage 142 in the lower direction, and then the lubricating oil is supplied to the bearing portion 111*b*. Further, part of the lubricating oil which circulates inside the second lubricating oil passage 142 is supplied to the thrust bearing oil passage 143*a* of the compressor-side housing 110 via the compressor-side branch oil passage 142*a*.

The lubricating oil supplied to the bearing portion 111*b* circulates between the bearing portion 111*b* and the sliding bearing 80, and damps a vibration of the sliding bearing 80. Further, the lubricating oil circulates from a through-hole appropriately formed on an outer peripheral surface of the sliding bearing 80 to the inside of the sliding bearing 80. The lubricating oil circulates between the sliding bearing 80 and the shaft 20, lubricates a relative rotation of the sliding bearing 80 and the shaft 20, and cools the bearing portion.

The lubricating oil having lubricated the bearing portion 111*b*, the sliding bearing 80, and the shaft 20 circulates to a front end portion of the bearing portion 111*b* (end portion at the turbine 40 side) or the back end portion of the bearing portion 111*b* (end portion at the compressor 30 side), and then the lubricating oil is supplied to the compressor-side horizontal oil passage 143*b* via either the thrust bearing oil passage 143*a* or the turbine-side vertical oil passage 143*c*. The lubricating oil supplied to the compressor-side horizontal oil passage 143*b* is discharged from the bottom surface of the body portion 111 in the compressor-side housing 110 via the discharge oil passage 143*d* to the outside of the bearing housing 100.

Thus, the lubricating oil is circulated from the upper surface of the bearing housing 100 via the bearing portion 111*b* to a lower surface of the bearing housing 100 (bottom surface of the body portion 111) so that the lubricating oil can be smoothly circulated in accordance with gravity. Further, the lubricating oil is discharged from the front end and the back end of the bearing portion 111*b* so that the lubricating oil can be smoothly circulated and can be surely guided from the front end to the back end of the bearing portion 111*b*.

As described above, the bearing housing 100 of the turbocharger 10 according to the present embodiment contains the shaft 20 connecting the turbine 40 and the compressor 30, and turnably supports the shaft 20. The bearing housing 100 of the turbocharger 10 is divided into the turbine-side housing 120 disposed at the turbine 40 side and the compressor-side housing 110 disposed at the compressor 30 side. The turbine-side housing 120 and the compressor-side housing 110 are subjected to machining to thereby form the cooling water passage 130 for supplying cooling water and the lubricating oil passage 140 for supplying lubricating oil.

With this configuration, since the cooling water passage 130 and the lubricating oil passage 140 formed in the bearing housing 100 are formed by performing machining, there is no necessity to use a core when the bearing housing 100 is manufactured by casting. Thus, it is possible to achieve cost reduction. Further, since there is no necessity to form the cooling water passage 130 and the lubricating oil passage 140 by using a sand core at the casting stage, inspecting whether foundry sand is remaining inside the cooling water passage 130 and inside the lubricating oil passage 140 is not needed. Further, by dividing the bearing housing 100 into two members, it is possible to improve workability (easily perform machining) of the cooling water passage 130 and the lubricating oil passage 140.

The lubricating oil passage 140 through which the shaft 20 is inserted, includes the bearing portion 111*b* that is a through-hole for turnably supporting the shaft 20, the second lubricating oil passage 142 which communicates the upper surface of the bearing housing 100 with the bearing portion 111*b*, and the first lubricating oil passage 143 which communicates the lower surface of the bearing housing 100 with the bearing portion 111*b*.

With this configuration, it is possible to simplify a shape of the lubricating oil passage 140, and further to improve workability of the lubricating oil passage 140. Further, by supplying the lubricating oil to the inside of the bearing housing 100 via the second lubricating oil passage 142, the lubricating oil sequentially circulates through the second lubricating oil passage 142, the bearing portion 111*b*, and the first lubricating oil passage 143 in accordance with gravity. Thus, it is possible to circulate the lubricating oil smoothly.

The second lubricating oil passage 143 is formed so as to communicate each of an end portion of the bearing portion 111*b* at the compressor 30 side and an end portion of the bearing portion 111*b* at the turbine 40 side with the lower surface of the bearing housing 100.

With this configuration, the lubricating oil can be discharged from both the end portions of the bearing portion 111*b* in the lower direction of the bearing housing 100, and thereby the lubricating oil can be circulated smoothly. Further, the lubricating oil can be surely guided to both the ends of the bearing portion 111*b*, and thereby the bearing portion 111*b* can be lubricated and cooled effectively.

On at least one of a surface, which is in contact with the compressor-side housing 110, of the turbine-side housing 120 and a surface, which is in contact with the turbine-side housing 120, of the compressor-side housing 110, as the cooling water passage 130, an arc-shaped cooling water passage in an arc shape centered at the shaft 20 (the compressor-side arc-shaped cooling water passage 131 and the turbine-side arc-shaped cooling water passage 132) is formed.

With this configuration, by forming the cooling water passage so as to surround a periphery of the shaft 20, it is possible to effectively suppress a temperature rise of the bearing housing 100 caused by heat transferred from the turbine 40 side via the shaft 20 or heat generated by the rotation of the shaft 20.

The lubricating oil passage 140 is subjected to a process for reducing the surface roughness.

With this configuration, flow resistance of the lubricating oil passage 140 can be reduced, and thus machine efficiency of the turbocharger 10 can be improved. Further, since lubricating oil does not easily stay in the lubricating oil passage 140, occurrence of oil caulking can be reduced.

The bearing housing 100 of the turbocharger 10 according to the present embodiment contains the shaft 20 connecting the turbine 40 and the compressor 30, and turnably supports the shaft 20. The bearing housing 100 of the turbocharger 10 is divided into the turbine-side housing 120 disposed at the turbine 40 side and the compressor-side housing 110 disposed at the compressor 30 side. The compressor-side housing 110 is formed of an aluminum-based material.

With this configuration, since the compressor-side housing 110 to be at a relatively low temperature is formed of an aluminum-based material, the weight of the bearing housing 100 can be reduced.

On an outer peripheral surface of the compressor-side housing 110, a heat sink portion 111*c* for dissipating heat transferred to the compressor-side housing 110 is formed.

With this configuration, it is possible to suppress a temperature rise of the bearing housing 100 disposed under a high-temperature environment (specifically, heat from engine exhaust or heat generated by rotation of the shaft 20 are transferred).

The turbine-side housing 120 is formed of stainless steel.

Thus, since the turbine-side housing 120 to be at a relatively high temperature is formed of stainless steel, it is possible to prevent deformation, damage, and the like due to a high temperature. Further, since the turbine-side housing 120 formed of stainless steel shields heat, it is possible to prevent deformation, damage, and the like, which are caused by heat, of the compressor-side housing 110 formed of an aluminum-based material. Further, since stainless steel has a low surface roughness compared to the cast iron, lubricating oil does not easily stay in the turbine-side housing 120. Thus, it is possible to reduce the occurrence of oil caulking.

The turbocharger 10 according to the present embodiment includes the shaft 20 connecting the turbine 40 and the compressor 30, the bearing housing 100 having the bearing portion 111*b* which turnably supports the shaft 20, and the sliding bearing 80 interposed between the shaft 20 and the bearing portion 111*b*. The bearing portion 111*b* is formed of an aluminum-based material, the shaft 20 is formed of a steel material, and the sliding bearing 80 is formed of a copper-based material.

With this configuration, in the case where the temperature of the bearing portion 111*b* rises, the inner diameter of the bearing portion 111*b* formed of an aluminum-based material is expanded larger than the outer diameter of the sliding bearing 80 formed of a copper-based material. Accordingly, the amount of the lubricating oil interposed between the bearing portion 111*b* and the sliding bearing 80 is increased, and thereby it is possible to reduce the whirl vibration. Similarly, in the case where the temperature of the bearing portion 111*b* rises, the inner diameter of the sliding bearing 80 formed of a copper-based material is expanded larger than the outer diameter of the shaft 20 formed of a steel material. Accordingly, the amount of the lubricating oil interposed between the sliding bearing 80 and the shaft 20 is increased, and thereby it is possible to reduce the whirl vibration. Further, since the inner diameter of the bearing portion 111*b* formed of an aluminum-based material has a high thermal conductivity, heat generated in the bearing portion 111*b* is effectively absorbed and conducted. The temperature of the bearing portion 111*b* is lowered so that deformation, damage, and the like due to the heat can be prevented effectively.

The bearing housing 100 is divided into the turbine-side housing 120 disposed at the turbine 40 side and the compressor-side housing 110 disposed at the compressor 30 side. The turbine-side housing 120 is formed of stainless steel, and the bearing portion 111*b* is formed in the compressor-side housing 110.

Thus, since the turbine-side housing 120 to be at a relatively high temperature is formed of stainless steel, it is possible to prevent deformation, damage, and the like due to a high temperature. Further, since the turbine-side housing 120 formed of stainless steel shields heat, it is possible to prevent deformation, damage, and the like, which are caused by heat, of the bearing portion 111*b* formed of an aluminum-based material.

The metal gasket 150 is interposed between the turbine-side housing 120 and the compressor-side housing 110.

Thus, the metal gasket 150 is interposed between the turbine-side housing 120 and the compressor-side housing 110 so that it is possible to shield heat from the turbine 40 side, and to more effectively prevent deformation, damage, and the like, which are caused by heat, of the bearing portion 111*b* formed of an aluminum-based material.

In the present embodiment, the heat sink portion 111*c* formed in the body portion 111 of the compressor-side housing 110 is formed to have a plurality of plate-shaped (fin-shaped) portions. However, the present invention is not limited to this embodiment. Specifically, the heat sink portion 111*c* may be of a shape for increasing a surface area of the body portion 111, for example, the heat sink portion 111*c* can be formed into a lobe shape, a spiral shape, a pinholder shape, a bellows shape, and the like.

Further, in the present embodiment, the turbine-side housing 120 is formed by a sheet metal process using stainless steel. However, the present invention is not limited to this embodiment, and for example, the turbine-side housing 120 can be formed by casting using cast iron.

Further, in the present embodiment, the lubricating oil passage 140 is subjected to a process for reducing the surface roughness. However, the present invention is not limited to this embodiment, and it is possible to perform a process for reducing the surface roughness to the cooling water passage 130. Thereby, it is possible to reduce flow resistance of cooling water which circulates inside the cooling water passage 130.

Figure 17B:
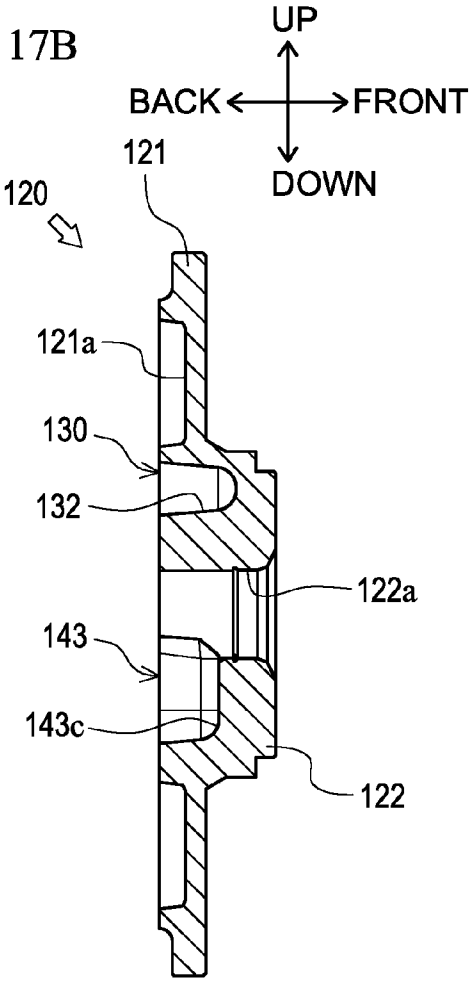
FIG. 17B is a cross-sectional view of the turbine-side housing taken along line H-H of FIG. 17A.
Figure 17A:
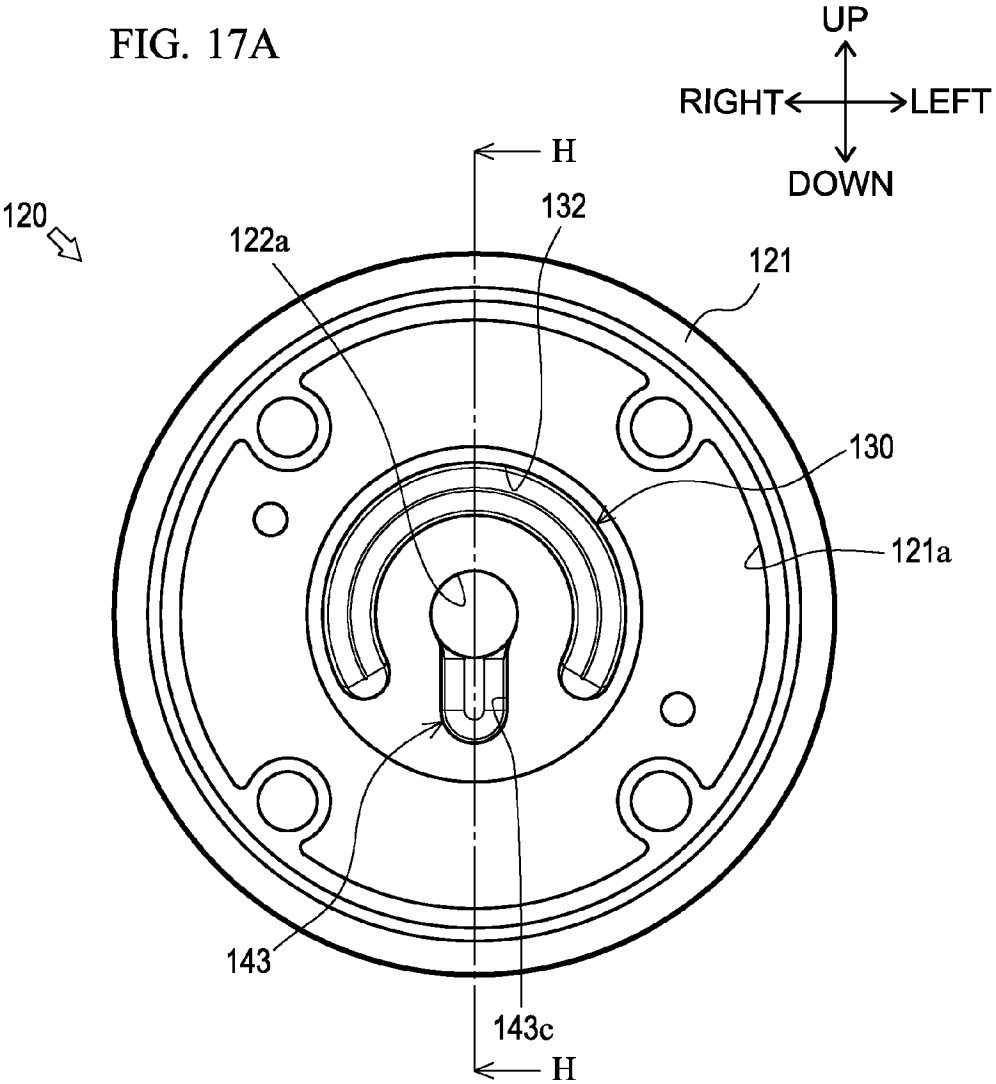
FIG. 17A is a back view of a turbine-side housing according to another embodiment of the present invention.

As other embodiment, as shown in FIG. 17, it is also possible to form a recess 121*a* in the turbine-side housing 120.

The back surface of the turbine-side housing 120 is subjected to machining such as cutting and grinding, or press working to thereby form the recess 121*a*. The recess 121*a* is formed on the back surface of the turbine-side housing 120 over a wide range as much as possible.

The back surface of the turbine-side housing 120 as configured above and the front surface of the compressor-side housing 110 (refer to FIGS. 4 to 8) are fixed to each other in an abutting manner, so that the recess 121*a* is formed on the back surface of the turbine-side housing 120, thereby reducing a contact area between the turbine-side housing 120 and the compressor-side housing 110. Thus, in the case where the temperature of the turbine-side housing 120 becomes high, the heat is prevented from transferring to the compressor-side housing 110, and thus it is possible to prevent deformation, damage, and the like, which are due to a high temperature, of the compressor-side housing 110. Further, since space in which air exists inside the recess 121*a* is formed, it is possible to prevent heat from easily transferring to the compressor-side housing 110 by the space (layer of air).

As described above, in the bearing housing 100 of the turbocharger 10 according to the present embodiment, the recess 121*a* is formed on the surface (back surface), which is in contact with the compressor-side housing 110, of the turbine-side housing 120.

With this configuration, it is possible to prevent heat of the turbine-side housing 120 from easily transferring to the compressor-side housing 110.

In the present embodiment, the recess 121*a* is formed in the turbine-side housing 120, however, the present invention is not limited to this embodiment. Specifically, there may be a configuration in which a recess is formed on the surface (front surface), which is in contact with the turbine-side housing 120, of the compressor-side housing 110, or a configuration in which a recess is formed on both surface of the back surface of the turbine-side housing 120 and the front surface of the compressor-side housing 110.

INDUSTRIAL APPLICABILITY

The present invention can be applied to a turbocharger bearing housing provided in an internal combustion engine.

REFERENCE SIGNS LIST

20 shaft
30 compressor
40 turbine
80 sliding bearing
100 bearing housing
110 compressor-side housing
111*b* bearing portion
111*c* heat sink portion
120 turbine-side housing
130 cooling water passage
131 compressor-side arc-shaped cooling water passage
132 turbine-side arc-shaped cooling water passage
140 lubricating oil passage
142 second lubricating oil passage
143 first lubricating oil passage
150 metal gasket

The invention claimed is:

1. A turbocharger bearing housing, comprising:

a turbine-side housing disposed at a turbine side and a compressor-side housing disposed at a compressor side, the turbine-side housing being connected to the compressor-side housing;

the turbocharger bearing housing including a bearing portion in the form of a through-hole extending therethrough for rotatably supporting a shaft that connects a turbine to a compressor; and the turbine-side housing and the compressor-side housing include:

a cooling water passage for supplying cooling water; and a lubricating oil passage for supplying lubricating oil to the bearing portion; the lubricating oil passage includes:

a first lubricating oil passage for communicating a lower surface of the bearing housing with the bearing portion; and an upper first lubricating oil passage for laterally communicating an end portion of the bearing portion at the compressor side with an end portion of the bearing portion at the turbine side, the upper first lubricating passage is formed in a lower portion of the bearing portion;

a lower first lubricating oil passage for longitudinally communicating a lubricating oil discharge port formed at a lower surface of the bearing housing with a middle portion in the lateral direction of the upper first lubricating oil passage;

the turbocharger bearing housing further comprises a water supply port and a water discharge port which are formed at the lower surface of the bearing housing, wherein the water supply port and the water discharge port are arranged symmetrically with respect to the lubricating oil discharge port in the lateral direction;

the cooling water passage includes:

an arc-shaped cooling water passage of an arc shape such that a bottom portion of a circular shape centered at the shaft is cut out, which is formed in at least one of:

a surface of the turbine-side housing, which is in contact with the compressor-side housing;

a surface of the compressor-side housing, which is in contact with the turbine-side housing;

a water supply passage for communicating one end portion of a lower portion of the arc-shaped cooling water passage with the water supply port; and a water discharge passage for communicating another end portion of the lower portion of the arc-shaped cooling water passage with the water discharge port; and the lower first lubricating oil passage is positioned between the water supply passage and the water discharge passage; and the upper first lubricating oil passage is formed so as to be positioned at the cut-out part of the bottom portion of the arc-shaped cooling water passage in a lateral direction view.

2. The turbocharger bearing housing according to claim 1, wherein the lubricating oil passage further includes a second lubricating oil passage for longitudinally communicating an upper surface of the bearing housing with the bearing portion, an upper portion of the arc-shaped cooling water passage is formed so as to curve around the second lubricating oil passage at the turbine side in a longitudinal direction view.

3. The turbocharger bearing housing according to claim 1, wherein the lubricating oil passage is subjected to a process for reducing surface roughness.

4. The turbocharger bearing housing according to claim 1, wherein the lubricating oil passage is subjected to a process for reducing surface roughness.

5. The turbocharger bearing housing according to claim 2, wherein the lubricating oil passage is subjected to a process for reducing surface roughness.

* * * * *